US008178985B2

(12) United States Patent
Hirose et al.

(10) Patent No.: US 8,178,985 B2
(45) Date of Patent: May 15, 2012

(54) ENGINE GENERATOR

(75) Inventors: Tadafumi Hirose, Wako (JP); Junji Hiranuma, Wako (JP); Masanori Shin, Wako (JP); Hitoshi Yuki, Wako (JP); Masashi Kai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 400 days.

(21) Appl. No.: 12/486,848

(22) Filed: Jun. 18, 2009

(65) Prior Publication Data

US 2009/0322097 A1 Dec. 31, 2009

(30) Foreign Application Priority Data

Jun. 27, 2008 (JP) ..... 2008-168853
Jun. 27, 2008 (JP) ..... 2008-168899

(51) Int. Cl.
*F02B 63/04* (2006.01)

(52) U.S. Cl. ..... 290/1 A; 290/10

(58) Field of Classification Search ..... 290/1 A, 290/1 B, 10; 123/41.6, 41.57, 41.31, 198 E, 123/41.65, 2; 280/47.371; 307/68
See application file for complete search history.

(56) References Cited

U.S. PATENT DOCUMENTS 4,647,835 A * 3/1987 Fujikawa et al. ..... 322/1
4,721,070 A * 1/1988 Tanaka et al. ..... 123/2
4,827,147 A * 5/1989 Mizushima ..... 290/1 A
5,014,660 A * 5/1991 Westerbeke, Jr. ..... 123/198 E
5,125,378 A * 6/1992 Westerbeke, Jr. ..... 123/198 E
5,899,174 A * 5/1999 Anderson et al. ..... 123/2
5,977,667 A 11/1999 Hirose
6,067,945 A 5/2000 Fukuda et al.
7,779,793 B2 * 8/2010 Ito et al. ..... 123/41.65
2003/0071465 A1 4/2003 Sugimoto et al.

FOREIGN PATENT DOCUMENTS

| | | | |
|---|---|---|---|
| DE | 1613745 | A1 | 5/1971 |
| EP | 0902178 | A2 | 3/1993 |
| EP | 0893585 | A2 | 1/1999 |
| EP | 1296040 | A | 3/2003 |
| FR | 1348604 | A | 1/1964 |
| JP | 61-92392 | A | 5/1986 |
| JP | 2005-133638 | A | 5/2005 |

OTHER PUBLICATIONS

European Search Report dated Sep. 30, 2009, issued in corresponding European Application No. 09163630.

* cited by examiner

*Primary Examiner* — Julio R Gonzalez
(74) *Attorney, Agent, or Firm* — Westerman, Hattori, Daniels & Adrian, LLP

(57) ABSTRACT

An engine generator having a high-rigidity rigid skeletal member. A bottom cover supports the engine/generator unit. A wall-shaped vertical frame is disposed transversely of the engine generator in a front section of the bottom cover and rising from the bottom cover front section. A T-shaped center frame extends between a rear section of the bottom cover and the vertical frame. The skeletal member includes the bottom cover, the vertical frame and the center frame.

10 Claims, 19 Drawing Sheets

12(21)
164
37
145
149
25
163
33
144
152
204
113
212
204
115
38
143
25b
32
H3
H2

ENGINE GENERATOR

FIELD OF THE INVENTION

The present invention relates to an engine generator in which a generator driven by an engine is accommodated inside a case together with the engine.

BACKGROUND OF THE INVENTION

Japanese Laid-open Patent Publication No. 2005-133638 discloses an engine generator in which an engine and a generator are accommodated in a noise-reducing (muffling) case.

The engine generator is provided with a skeletal section of the case formed by a reinforced frame having an inverted U-shape in cross-section erectly disposed on the two side sections of the bottom plate for supporting the engine and the generator. The skeletal section is covered by a resin case. The engine and the generator are accommodated inside the case and a grip for transporting the case is integrally provided to form a small engine generator.

The small engine-driven generator has lower end sections of a pair of reinforcement frames having an inverted U-shape in cross section that are connected only by a bottom plate, and has upper end sections of a pair of reinforcement frames that are not connected by a reinforcement member. Accordingly, the upper end sections of the pair of reinforcement frames are supported by the resin case. Since the engine generator is small, the upper end sections of the pair of reinforcement frames can be supported by the resin case.

However, since the weight is increased when the engine generator is relatively large, it is difficult to use the resin case to support the upper end sections of the pair of reinforcement frames that are an inverted U-shape in cross section. As a countermeasure, it is possible to consider a method in which the rigidity is improved by replacing the resin case with a steel case. However, the weight of the engine generator is increased and the transportability of the engine generator is compromised when the resin case is replaced with a steel case.

SUMMARY OF THE INVENTION

An object of the present invention is to provide an engine generator that can be made more lightweight and in which rigidity can be assured.

According to an aspect of the present invention, there is provided an engine generator which comprises: an engine/generator unit in which an engine and a generator driven by the engine are provided as an integrated unit; an electrical component section for controlling an output of the engine/generator unit; a case for accommodating the electrical component section and the engine/generator unit; a bottom cover for supporting the engine/generator unit; a wall-shaped vertical frame provided transversely of the engine generator and rising from a vicinity of one end of the bottom cover; and a center frame extending between an upper center section of the vertical frame and a center section of an opposite end of the bottom cover and disposed above the engine/generator unit, wherein the skeletal member comprises the bottom cover, the vertical frame and the center frame, and the vertical frame and the center frame are formed in a T-shape as viewed in top plan.

With this arrangement, the vertical frame can be prevented from toppling in a width direction (i.e., lateral direction) of the engine generator by mounting the two ends of the lower end section of the vertical frame on the bottom cover.

The center frame is placed across the upper center section of the vertical frame and the other-end center section of the bottom cover, and the vertical frame and the center frame are formed substantially in a T shape as viewed from above. Thus, the center frame can prevent the vertical frame from toppling in the direction perpendicular to the vertical frame surface. A highly rigid skeletal member can thereby be formed using the bottom cover, the vertical frame, and the center frame. Rigidity of the case can be reduced by supporting the case using a highly rigid skeletal member. Therefore, the engine-driven generator can be made more lightweight because the case can be formed from polypropylene (PP) or another resin.

Preferably, the vertical frame partitions an accommodation space inside the case into a unit accommodation area in which the engine/generator unit is disposed, and into an electrical-component-section-accommodating area in which the electrical component section is disposed. With this arrangement, the environmental temperature of the electrical component section can be kept at an optimum level by using the vertical frame to separate the engine/generator unit and the electrical component section. Thus, a partitioning wall is not required to be separately provided because the vertical frame can also serve as a partitioning wall. Accordingly, the number of components can be reduced and the configuration can be made even more lightweight.

Desirably, the engine has a drive shaft that extends perpendicularly to the center frame, while the engine is disposed on one side of the center frame and the generator is disposed on an opposite side of the center frame. The center frame may include a heat insulating member which partitions the unit accommodation area into a hot area for disposing the engine and a cool area for disposing the generator. Thus, the environmental temperature of the engine generator disposed in the cool area can be optimally maintained. In this manner, the configuration of the insulation member can be simplified and made more lightweight by using the center frame to support the insulation member.

In a preferred form, the center frame comprises: a frame beam section extending horizontally along the bottom cover from the upper center section of the vertical frame to the opposite end center section of the bottom cover; and a frame leg section extending downwardly from a distal end of the frame beam section to the opposite end center section of the bottom cover, the frame beam section and the frame leg section being formed into an L-shape. With the frame beam section disposed in a relatively high position, a relatively large space is formed below the frame beam section. A space for arranging the engine/generator unit can thereby be readily provided below the frame beam section.

Preferably, the engine generator further comprises: an elastic seal member, being provided between the center frame and the engine/generator unit, for defining an area for accommodating the engine and an area for accommodating the generator; a center bump stopper, formed integrally with the elastic seal member, for minimizing vibrations of the engine/generator unit; and a bump seat section, disposed on the center frame, for contacting with the center bump stopper, so that a horizontal component of the vibrations of the engine/generator unit is minimized as a result of the center bump stopper making contact with the bump seat section.

With this arrangement, it becomes possible to locate the center bump stopper above the center section of the engine-generator unit.

The center of gravity position of the engine/generator unit is positioned in substantially the center of the engine/generator unit. Accordingly, the center bump stopper can be brought close to the center of gravity position of the engine/generator unit. The engine/generator unit vibrates about the center of gravity position. As a result, the amount of vibration of the center bump stopper brought close to the center of gravity position can be reduced. The load placed on the center bump stopper by the vibrations can thereby be reduced. Therefore, vibrations can be reduced with a more compact center bump stopper and the engine-driven generator can be made smaller. Also, having the center bump stopper integrally formed with the elastic seal material makes it possible to avoid increasing the number of components. Steps for assembling the center bump stopper can thereby be reduced and productivity can be improved.

Desirably, the center frame includes a muffler bump stopper capable of making contact with a muffler disposed above the engine, and a horizontal component of the vibrations of the engine/generator unit is minimized as a result of the muffler bump stopper making contact with the muffler. With the center frame disposed above the center section of the engine/generator unit, the muffler bump stopper can be brought close to the center of gravity position of the engine/generator unit. The amount of vibration of the muffler bump stopper can thereby be reduced in the same manner as the center bump stopper. Thus, vibrations can be reduced with a more compact muffler bump stopper, and the engine-driven generator can be made smaller.

In a preferred form, the bottom cover includes a bottom bump stopper that makes contact with a bottom section of the engine/generator unit, and a vertical component of the vibrations of the engine/generator unit is minimized as a result of the bottom bump stopper making contact with the bottom section of the engine/generator unit.

The bottom bump stopper is preferably caused to make contact in the vicinity of the external periphery of the bottom section of the engine/generator unit in order to reduce the vertical component of the vibrations of the engine/generator unit. On the other hand, the vicinity of the external periphery of the bottom section is a location set relatively away from the center of gravity position of the engine/generator unit, and is it possible that the amount of vibration will be increased. However, the vibrations of the engine/generator unit are reduced by the center bump stopper of claim 1. Accordingly, the amount of vibration can be reduced in the location that makes contact with the bottom bump stopper. The vibrations in the contact location can thereby be sufficiently reduced even when the bottom bump stopper is made more compact.

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

Throughout the description of the present embodiment, the term "forward direction" represents a direction in which an engine generator 10 is pulled by a draw handle 125.

Figure 1:
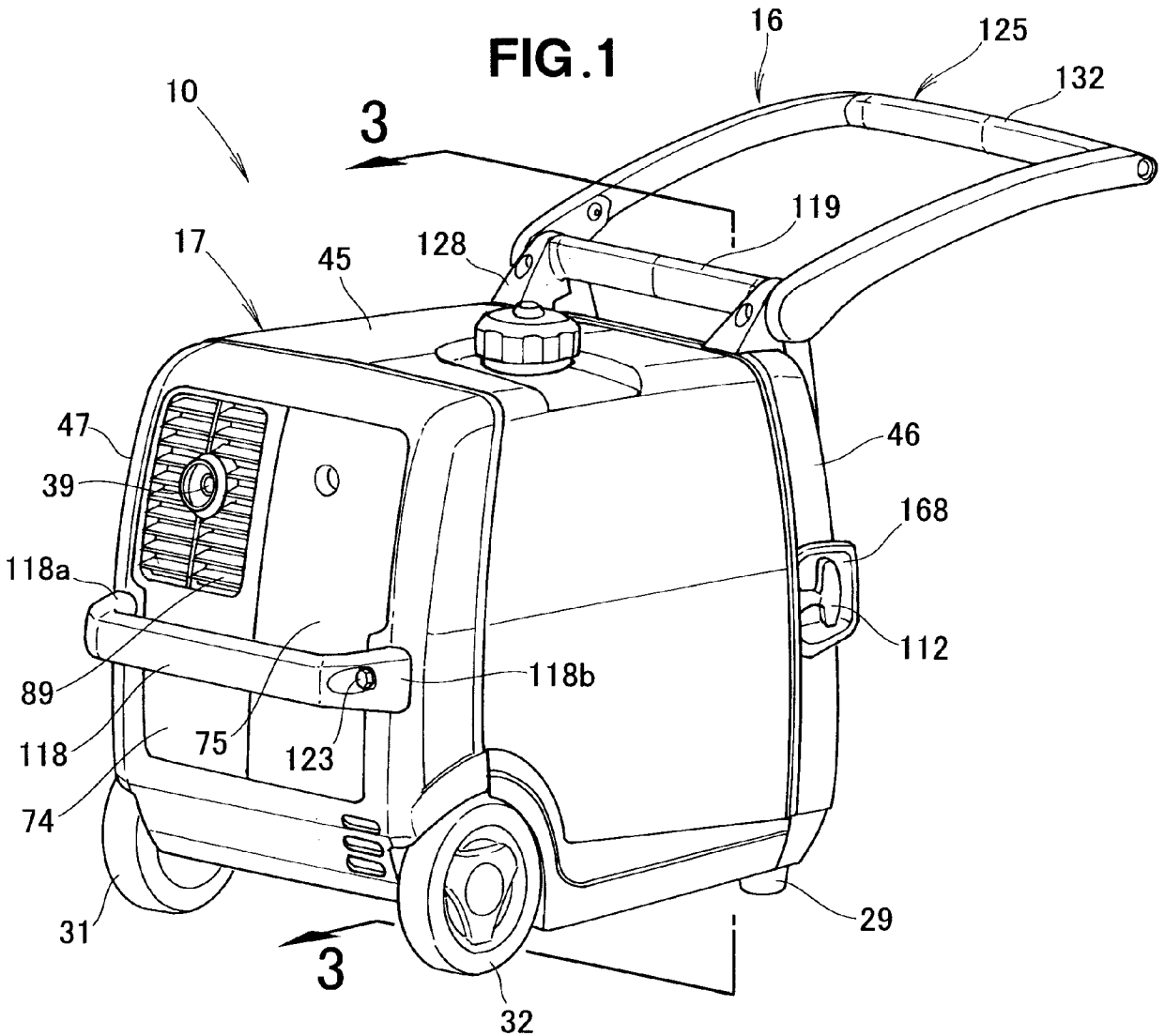
FIG. 1 is a perspective view showing an engine generator according to an embodiment of the present invention.
Figure 2:
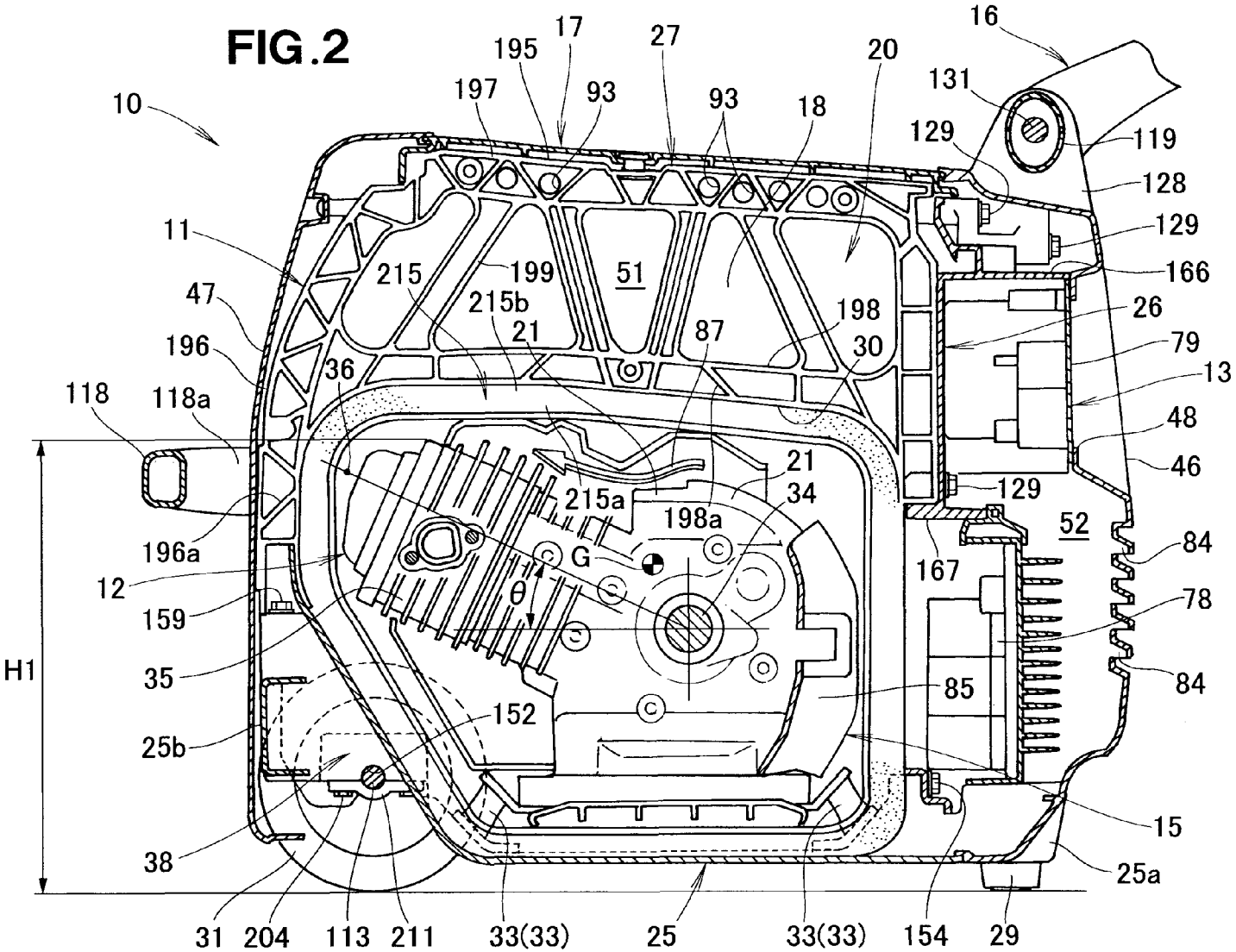
FIG. 2 is a cross-sectional view of the engine generator of FIG. 1.

The engine generator 10 shown in FIGS. 1 and 2 is provided with a skeletal member 11 that forms a main skeletal body, an engine/generator unit 12 provided to the skeletal member 11, and an electrical component section 13 for controlling the output of the engine/generator unit 12, an intake/fuel feed mechanism 14 (see FIG. 3) for feeding fuel to the engine/generator unit 12, a cooling structure 15 for directing cooling air to the engine/generator unit 12, a transport structure 16 for transporting the engine generator 10, a case 17 for covering the engine/generator unit 12 and the electrical component section 13, an insulating material 18 for partitioning accommodation space 20 inside the case 17, a muffler 23 (see FIG. 3) provided to an engine 21 of the engine/generator unit 12, and vibration suppressing means 28 (see FIGS. 11 and 13) for minimizing vibrations of the engine/generator unit 12.

The skeletal member 11 is composed of a bottom cover 25 for supporting the engine/generator unit 12, a wall-shaped vertical frame 26 erectly disposed in the vicinity of the front-end section (one end section) 25*a* of the bottom cover 25, and a center frame 27 that extends between the upper center section 26*a* (FIG. 5) of the vertical frame 26 and the rear end center section (other-end center section) 25*e* (FIG. 5) of the bottom cover 25. The center frame 27 is disposed above the center section 24 of the engine/generator unit 12, as shown in FIG. 3.

The engine generator 10 has left and right leg sections 29 provided to the front-end section (one end section) 25*a*, and left and right wheels 31, 32 provided to a rear-end section 25*b* of the bottom cover 25 of the skeletal member 11. The left and right leg sections 29 are each formed using a rubber member. The bottom cover 25 is horizontal when the left and right leg sections 29 and the left and right wheels 31, 32 are in contact with the ground.

The engine/generator unit 12 is mounted on the bottom cover 25 of the skeletal member 11 via four mounting members (mount members) 33. The engine 21 and a generator 22 (see FIG. 3) driven by the engine 21 are integrally provided to the engine/generator unit 12.

Figure 3:
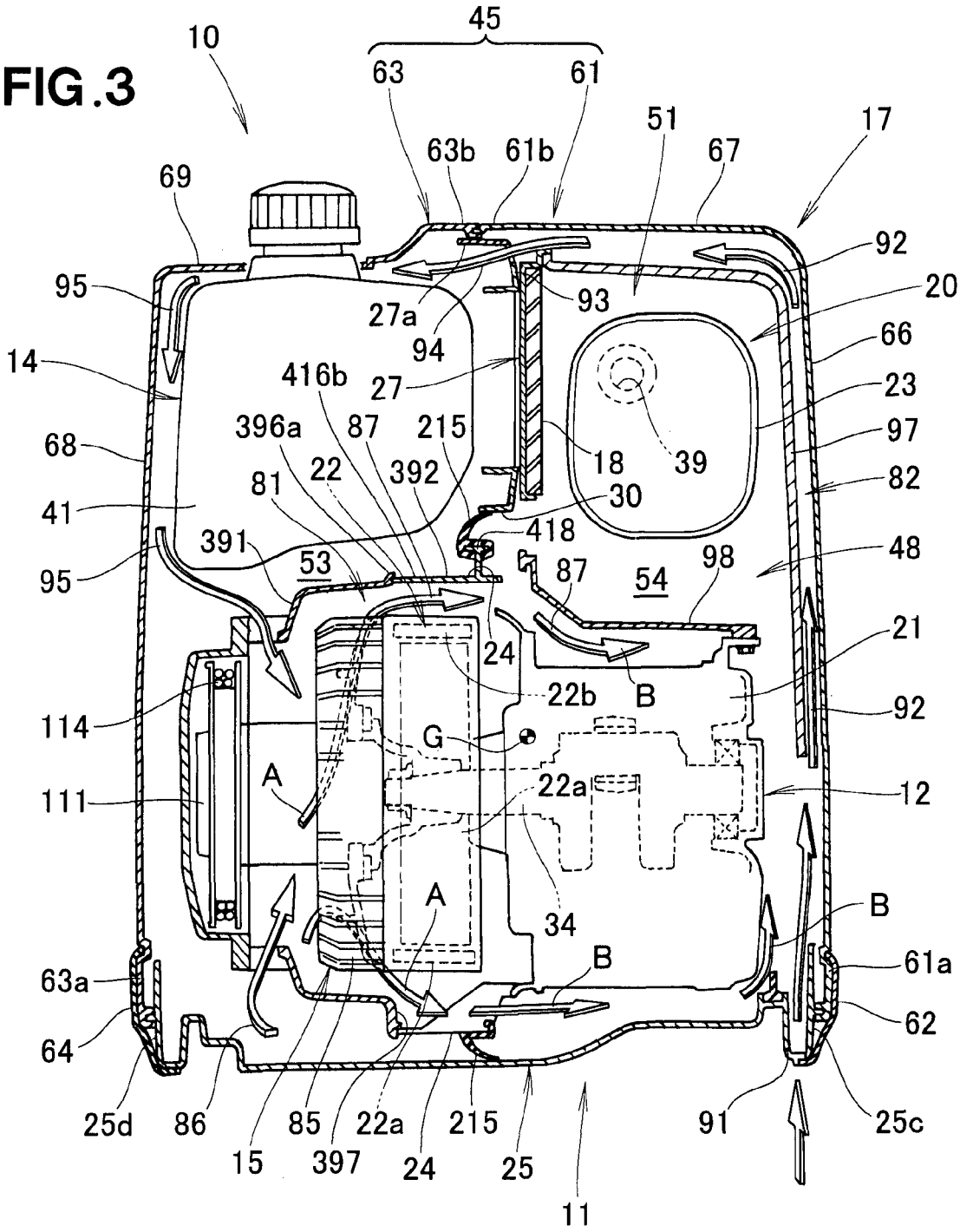
FIG. 3 is a cross-sectional view taken along line 3-3 of FIG. 1.

The generator 22 is coaxially provided to a drive shaft (crankshaft) 34 of the engine 21 (see FIG. 3). A cylinder block 35 of the engine 21 is inclined at an angle of θ to the left and right wheels 31, 32 (i.e., the direction of a shaft 113 for supporting the left and right wheels 31, 32) using the drive shaft 34 as a support point.

Reference numeral 36 shown in FIG. 2 shows the center of the cylinder in the cylinder block 35. Inclining the cylinder block 35 of the engine 21 at angle θ enables the height H1 of the engine 21 to be reduced, the height of the engine generator 10 to be reduced, and the engine generator 10 to be made more compact.

Figure 10:
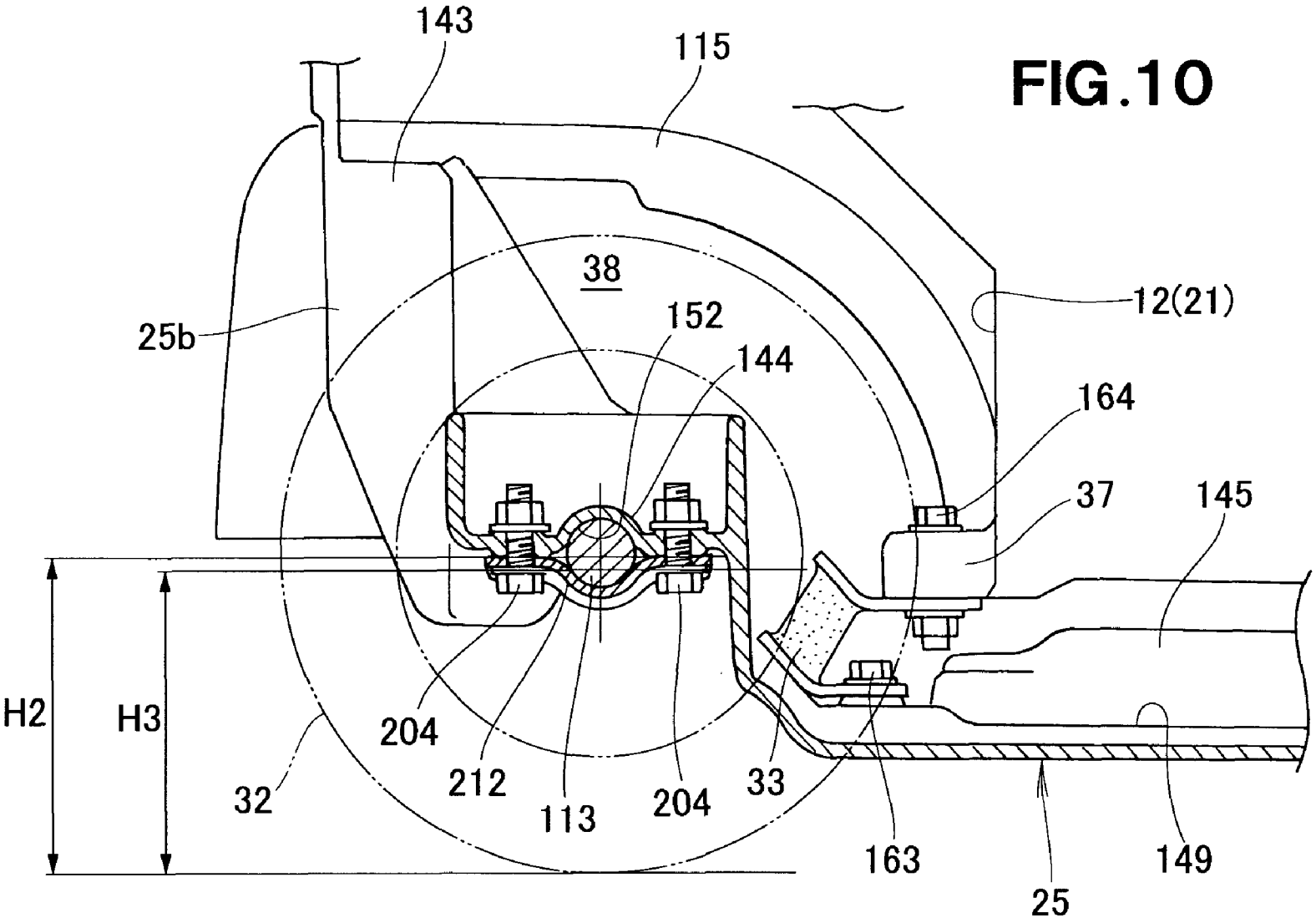
FIG. 10 is a cross-sectional view showing a relationship between the bottom cover and a shaft.
Figure 11:
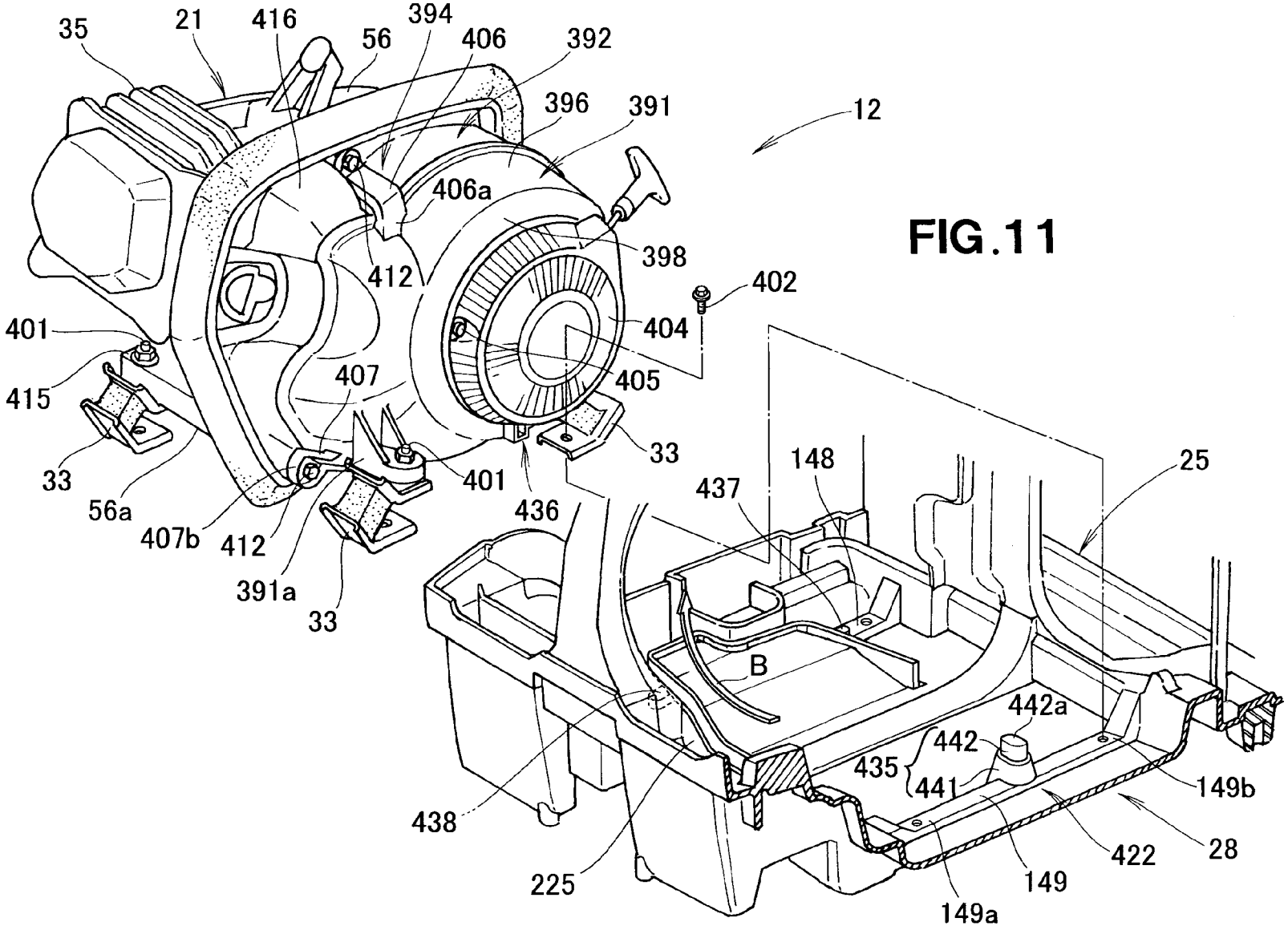
FIG. 11 is an exploded perspective view of the engine/generator unit with the bottom cover disassembled from the unit.
Figure 12:
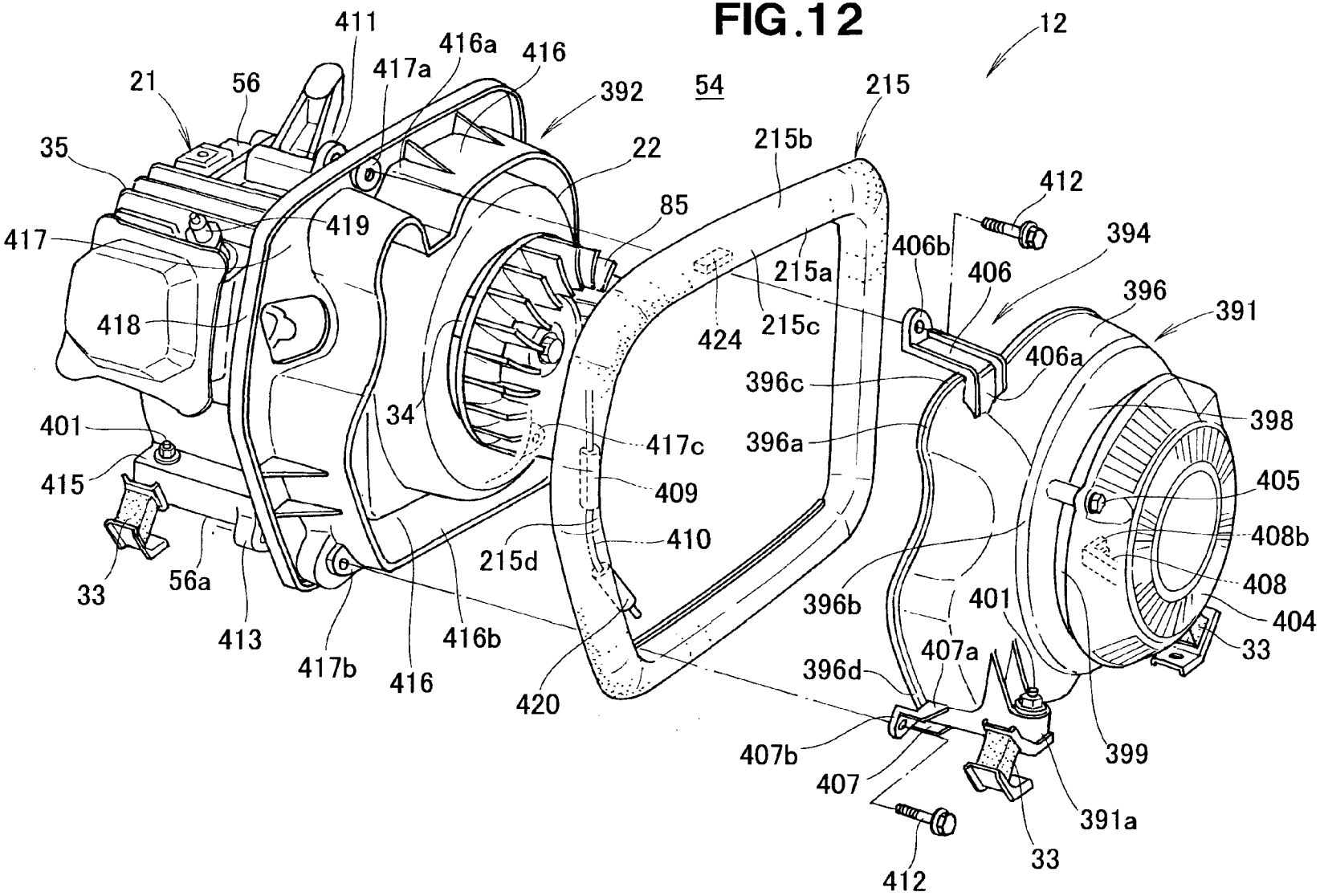
FIG. 12 is an exploded perspective view of the engine/generator unit of FIG. 11.

Adequate wheel accommodation space 38 can be provided below the cylinder block 35 in a state in which the cylinder block 35 of the engine 21 is inclined at the angle θ. The left and right wheels 31, 32 of the transport structure 16 are disposed in the wheel accommodation space 38. The engine generator 10 can be made even more compact by having the left and right wheels 31, 32 disposed in the wheel accommodation space 38. The structure for mounting the left and right wheels 31, 32 on the bottom cover 25 is shown in FIG. 10, and the engine/generator unit 12 is shown in FIGS. 11 and 12.

The electrical component section 13 controls the output of the engine/generator unit 12. The electrical component section 13 is provided with a control panel 79 in the upper half section, and with an inverter unit 78 in the lower half section.

Figure 4:
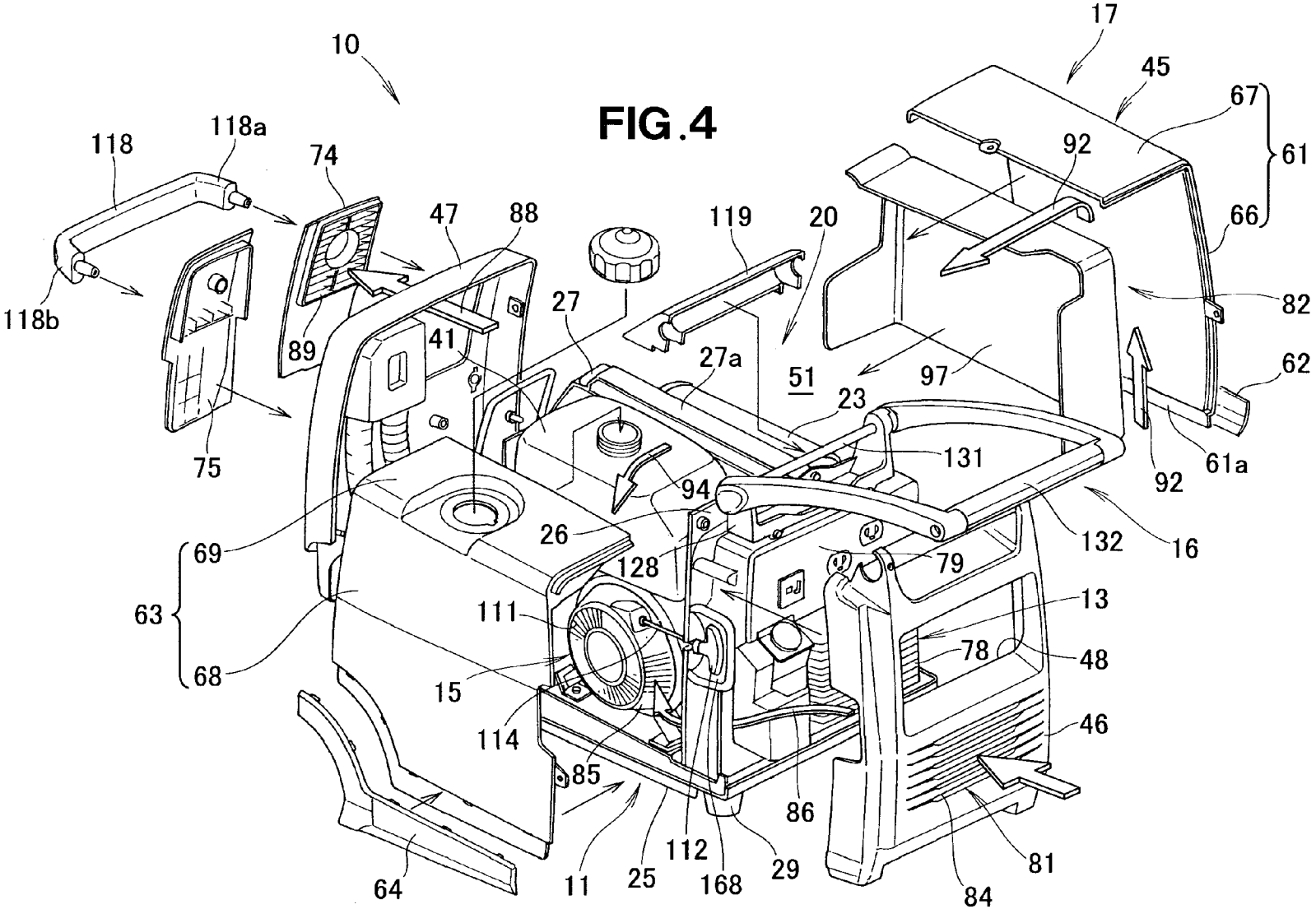
FIG. 4 is a perspective view of the engine generator of FIG. 1 with a case disassembled from the generator.

The engine/generator unit 12 is mounted on the bottom cover 25 in a state in which the drive shaft 34 of the engine 21 is laterally disposed in the left/right direction, as shown in FIGS. 3 and 4. The driving of the engine 21 in the engine/generator unit 12 causes the drive shaft 34 to rotate. The rotation of the drive shaft 34 is transmitted to a cooling fan 85 and the cooling fan 85 rotates. The rotation of the cooling fan 85 causes a rotor 22*a* of the generator 22 to rotate along the external periphery of a stator 22*b*. The rotation of the rotor 22*a* causes the generator 22 to generate power.

The muffler 23 is provided above the engine 21 of the engine/generator unit 12. Exhaust gas discharged from the cylinder block 35 (see FIG. 2) of the engine 21 is discharged from an exhaust port 39 (see FIG. 6).

A fuel tank 41 of the intake/fuel feed mechanism 14 is provided above the generator 22 of the engine/generator unit 12.

The engine/generator unit 12, the muffler 23, and the fuel tank 41 are accommodated inside the case 17, which is formed to be substantially U-shaped in cross section. The case 17 is formed from polypropylene (PP) or another resin, and is provided with a case main body 45, a front case section 46, and a rear case section 47. The case 17 is disposed above the bottom cover 25, whereby an accommodation space 20 is formed by the case 17 and the bottom cover 25. The accommodation space 20 is partitioned into a unit accommodation area 51 and an electrical component section accommodation area 52 (FIG. 2), and the unit accommodation area 51 is partitioned into a cool area 53 and a hot area 54. The engine/generator unit 12 is accommodated in the unit accommodation area 51, and the electrical component section 13 is accommodated in the electrical component section accommodation area 52. The engine 21 and the muffler 23 are accommodated in the hot area 54, and the generator 22 and the fuel tank 41 are accommodated in the cool area 53. A recoil starter 111, a cooling fan 85, the generator 22, and the fuel tank 41 are disposed in the cool area 53.

The cooling structure 15 cools the engine 21 and the muffler 23 by having the cooling fan 85 rotate to bring outside air to the cooling fan 85, sending the outside air, which is cooling air, to the engine 21 in the manner indicated by the arrow A by way of a fan cover 391 and a cover guide 392, and sending outside air directed to the engine 21 to the cylinder block 35 in the manner indicated by the arrow B by way of an engine shroud 98 and a bottom cover 25.

The case main body 45 covers the upper section and the left and right side sections of the unit accommodation area 51. The case main body 45 is provided with a left side case section 61 for covering the hot area 54, a decorative left cover 62 provided to the lower section of the left side case section 61, the right side case section 63 for covering the cool area 53, and a decorative right cover 64 provided to the lower section of the right side case section 63.

A lower end section 61*a* of the left side case section 61 is mounted on a left side section 25*c* of the bottom cover 25, and an upper end section 61*b* is mounted on an upper section 27*a* of the skeletal member 11 (center frame 27). The left side case section 61 is formed substantially to be L-shaped in cross-section by a left-side wall section 66 and a left upper wall section 67.

A lower end section 63*a* of the right side case section 63 is mounted on a right-side section 25*d* of the bottom cover 25, and an upper end section 63*b* is mounted on the upper section 27*a* of the skeletal member 11 (center frame 27). The right side case section 63 is formed substantially to be L-shaped in cross-section by a right-side wall section 68 and a right upper wall section 69.

An upper wall section of the case 17 is composed of the left upper wall section 67 of the left side case section 61 and the right upper wall section 69 of the right side case section 63.

The front case section 46 is formed into a substantially rectangular lid, is mounted on the bottom cover 25 of the skeletal member 11 or on a vertical frame 26 or the like, and constitutes the front wall section of the case 17. The front section of the electrical component accommodation area 52 (see FIG. 2) is covered by the front case section 46. The electrical component section 13 is accommodated in the electrical component section accommodation area 52.

The rear case section 47 is formed into a substantially rectangular lid, is mounted on the bottom cover 25 of the skeletal member 11 or on the center frame 27 or the like, and constitutes the rear wall section of the case 17. The rear section of the unit accommodation area 51 is covered by the rear case section 47. The rear case section 47 has a left-cover section 74 on the left half section and a right-cover section 75 on the right half section.

The cooling structure 15 is provided with a case cooling structure 82 for cooling the case 17, and an engine cooling structure 81 for cooling the inverter unit 78 of the electrical component section 13, the engine 21, and the muffler 23.

The engine cooling structure 81 is provided with an outside-air intake louver section 84 formed in the lower half section of the front case section 46, a first cooling channel 86 for guiding the outside air directed from the intake louver section 84 to the cooling fan 85 via the inverter unit 78, a second cooling channel 87 (see FIG. 2) for guiding the outside air directed from the cooling fan 85 to the cylinder block 35 of the engine 21, a third cooling channel 88 for guiding outside air that has passed by the cylinder block 35 to a discharge louver section 89, and the discharge louver section 89 for allowing the outside air guided to the third cooling channel 88 to escape. For purposes of convenience, the first cooling channel 86, the second cooling channel 87, and the third cooling channel 88 are indicated by arrows.

The second cooling channel 87 directs cooling air to the cylinder block 35, the second cooling channel 87 being formed by providing an engine shroud 98 above the cylinder block 35. The discharge louver section 89 is provided to the upper half section of the left cover section 74.

In the engine cooling structure 81, outside air is introduced from the intake louver section 84 to the inverter unit 78, the engine 21, and the muffler 23, whereby the inverter unit 78, the engine 21, and the muffler 23 are cooled by the outside air.

The casing cooling structure 82 is provided with an outside-air intake slit section 91 (see FIG. 8) formed in a left side section 25*c* of the bottom cover 25, a fourth cooling channel 92 for guiding the outside air directed from the intake slit section 91 to the area above the muffler 23 along the left side case section 61, a guide port 93 (see FIG. 2) formed in the center frame 27, a fifth cooling channel 94 for guiding the outside air of the fourth cooling channel 92 to the area above the fuel tank 41 via a plurality of the guide ports 93, and a sixth cooling channel 95 for guiding to the cooling fan 85 the outside air guided to the area above the fuel tank 41. For purposes of convenience, the fourth cooling channel 92, the fifth cooling channel 94, and the sixth cooling channel 95 are indicated by arrows.

The fourth cooling channel 92 is formed between the left side case section 61 and a case shroud 97 by having the case shroud 97 disposed at predetermined intervals in the left side case section 61.

In the casing cooling structure 82, outside air is introduced from the intake slit section 91 and guided along the inner surface of the left side case section 61 and the inner surface of the right side case section 63, whereby the left and right side case sections 61, 63 are cooled by the outside air.

Figure 5:
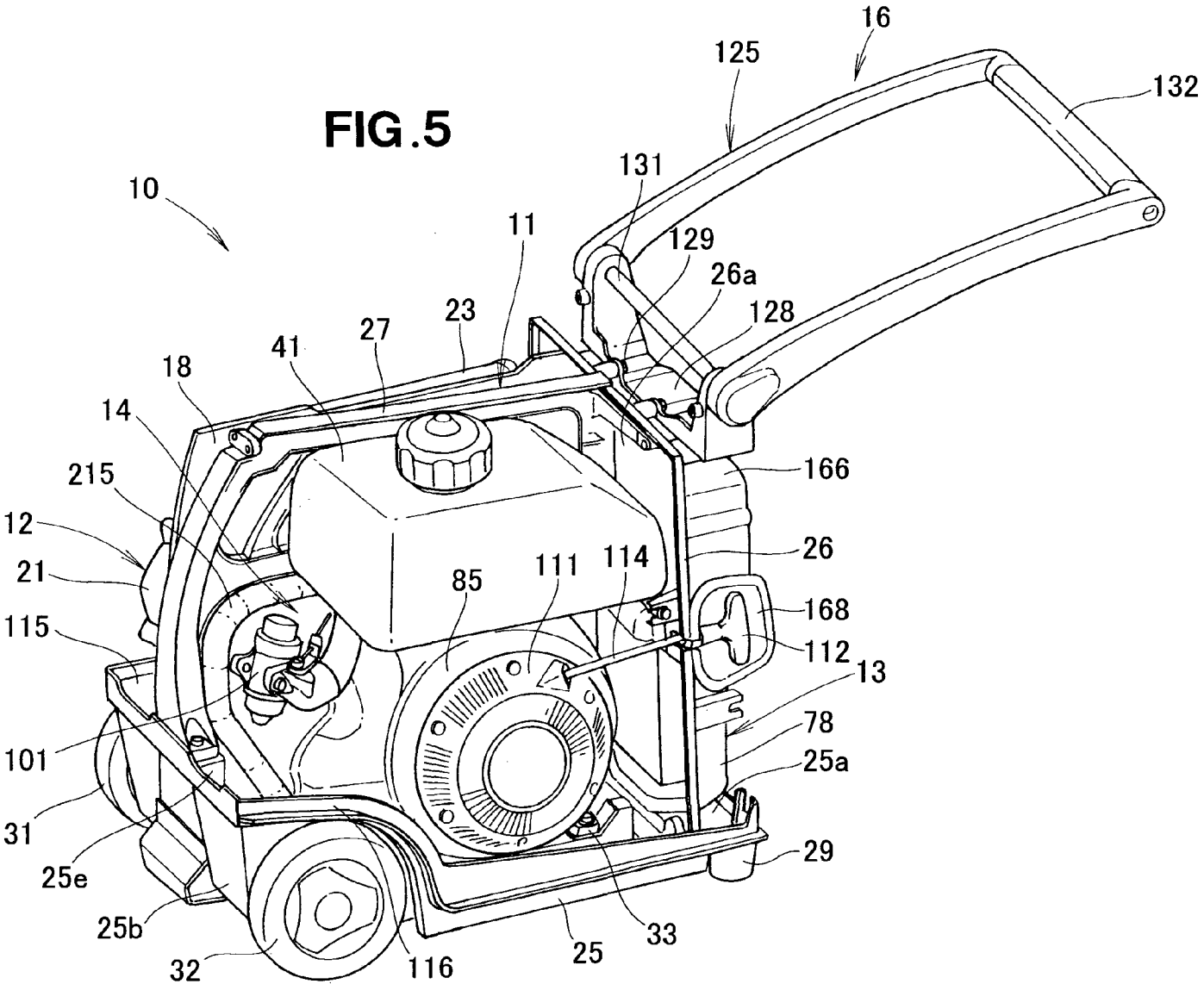
FIG. 5 is a perspective view of the engine generator of FIG. 1 with the case removed.
Figure 6:
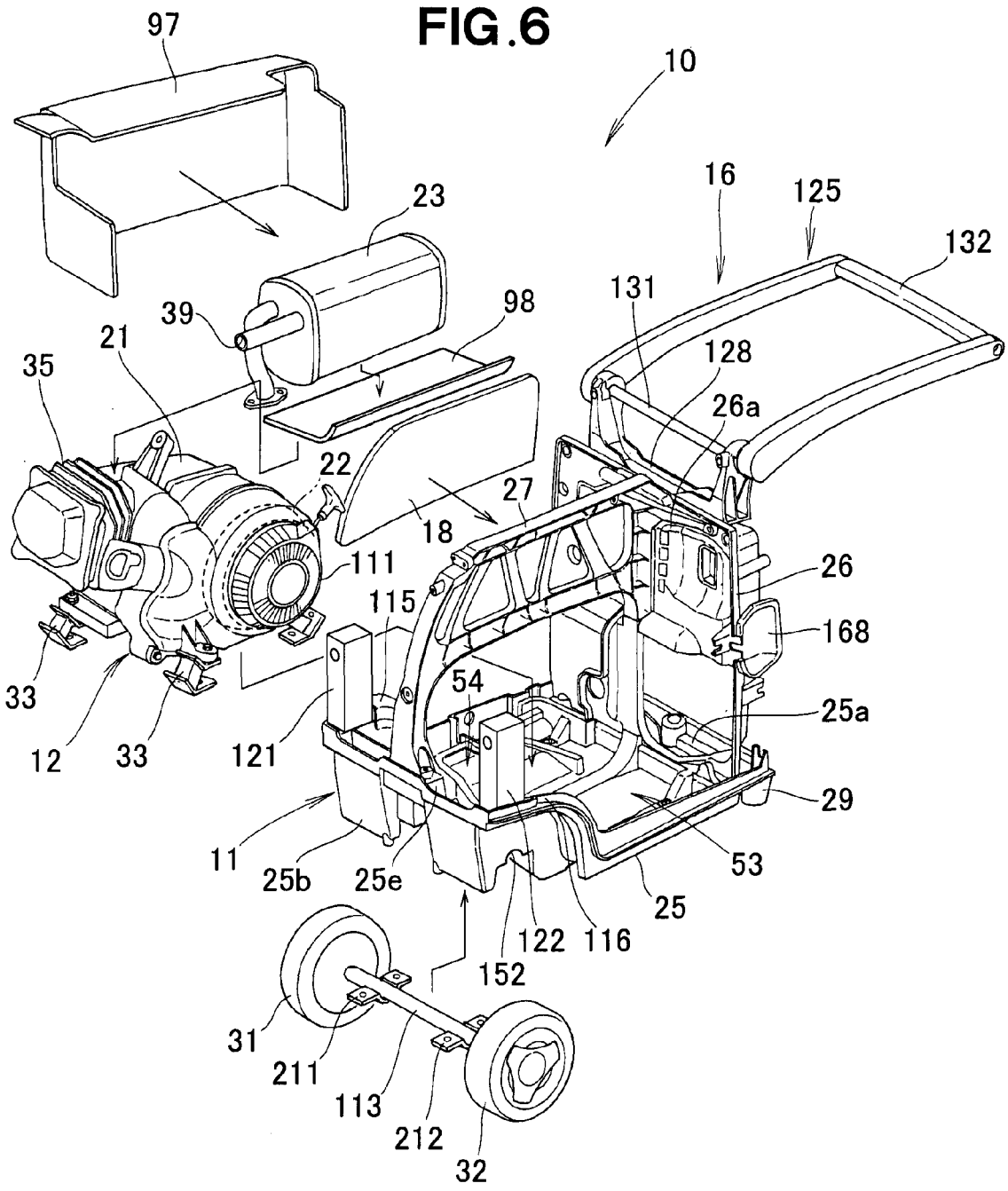
FIG. 6 is an exploded perspective view of the engine generator of FIG. 5.

For convenience, FIG. 5 shows the state in which the left and right handle mounting sections 121, 122 shown in FIG. 6 have been removed.

In FIGS. 5 and 6, intake/fuel feed mechanism 14 feeds fuel (air-fuel mixture) to the engine 21 of the engine/generator unit 12. The intake/fuel feed mechanism 14 is provided with a fuel tank 41 disposed above the generator 22 (see FIG. 3), and a carburetor 101 provided to the cylinder block 35 of the engine 21.

The fuel tank 41 is a tank for holding fuel to be fed to the engine.

The carburetor 101 mixes fuel brought from the fuel tank 41 with air brought from an air cleaner (not shown). The fuel tank 41 and the carburetor 101 are disposed in the area to the right of the center frame 27 (insulating material 18), i.e., in the cool area 53. The engine 21 and the muffler 23 are disposed in the area to the left of the center frame 27 (insulating material 18), i.e., in the hot area 54.

The skeletal member 11 is composed of the bottom cover 25 formed so as to be capable of supporting the engine/generator unit 12, the vertical frame 26 erectly disposed in the vicinity of the front-end section (one end part) 25*a* of the bottom cover 25, and a center frame 27 that extends between the upper center section 26*a* of the vertical frame 26 and the rear end center section (other-end center section) 25*e* of the bottom cover 25.

The engine/generator unit 12 integrally provided with the engine 21 and the generator 22 as described above is mounted on the bottom cover 25 of the skeletal member 11 via four mounting members (mount members) 33. The recoil starter 111 for starting the engine is provided to the engine 21. The exhaust muffler 23 is provided above the engine 21.

The case shroud 97 of the casing cooling structure 82 (see FIG. 3) is provided to the exterior of the muffler 23. The engine shroud 98 of the engine cooling structure 81 (see FIG. 3) is provided between the muffler 23 and the engine 21. The case shroud 97 and the engine shroud 98 guide outside air (cooling air) directed into the case 17. The muffler 23 and the engine 21 are partitioned by the engine shroud 98 into an upper area and a lower area (see FIG. 3).

The insulating member 18 is provided to the center frame 27 of the skeletal member 11. The insulating member 18 also serves as a shroud for guiding to the discharge louver section 89 (see FIG. 4) outside air (cooling air) directed to the cylinder block 35, for example.

The left and right wheels 31, 32 of the transport structure 16 are rotatably mounted on the bottom cover 25 of the skeletal member 11 via the shaft 113. In other words, left and right wheel housings 115, 116 are formed in the left and right end sections in the rear-end section 25*b* of the bottom cover 25. The left and right wheel housings 115, 116 bulge upward in a substantially curved shape so as to allow the left and right wheels 31, 32 to be accommodated. The left wheel 31 is disposed below the left wheel housing 115, and the right wheel 32 is disposed below the right wheel housing 116.

A rear stationary handle 118 of the transport structure 16 (see FIGS. 1 and 4) is provided to the rear-end section 25*b* of the bottom cover 25 via left and right handle mounting sections 121, 122. In other words, the left handle mounting section 121 is erectly disposed in the left side section of the rear-end section 25*b*. The right handle mounting section 122 is erectly disposed in the right side section of the rear-end section 25*b*. Left- and right-end parts 118*a*, 118*b* of the rear stationary handle 118 are secured to the left and right handle mounting sections 121, 122 using bolts 123 (see FIG. 1). The rear stationary handle 118 is formed in a U-shape as viewed from above.

Figure 9:
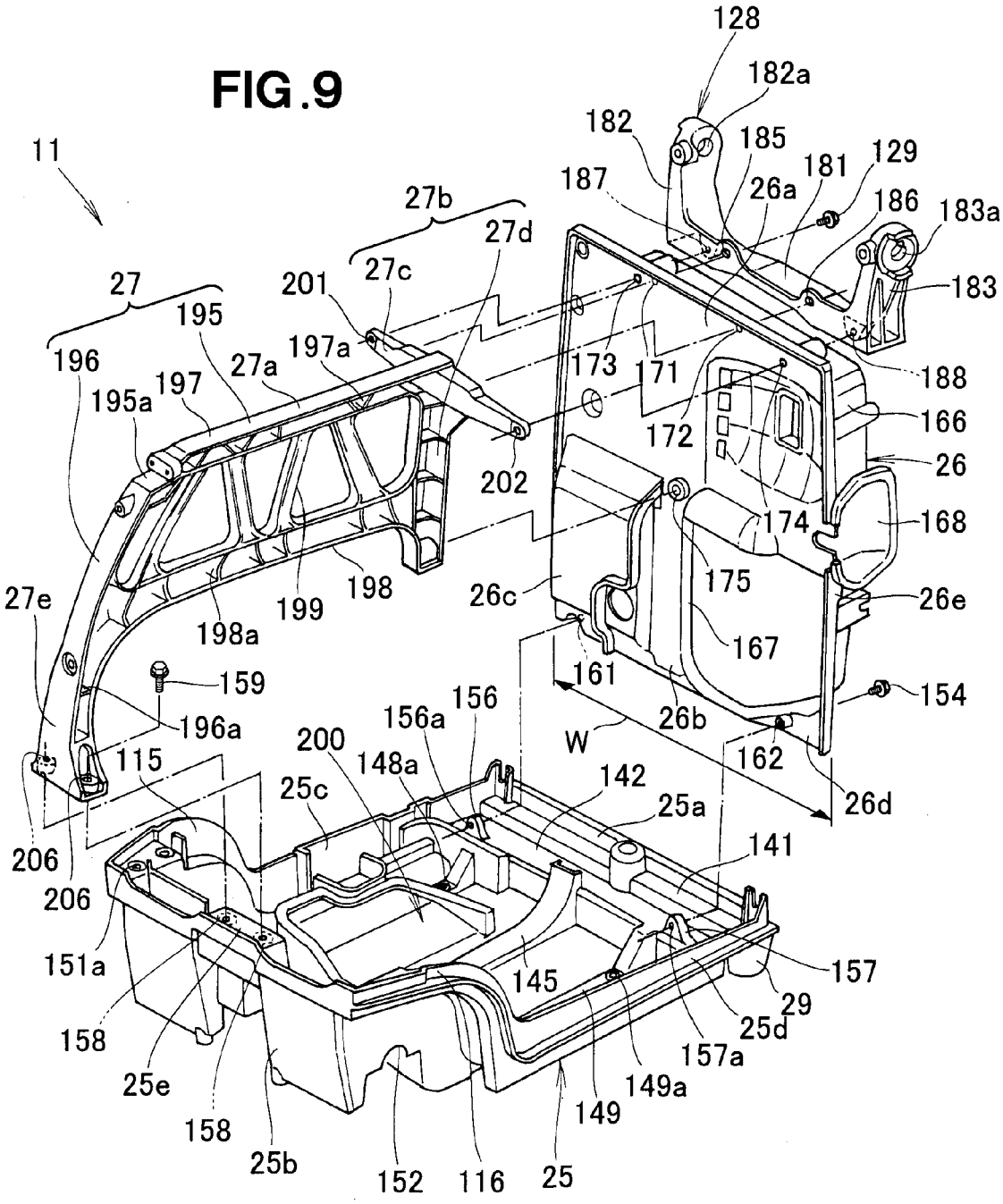
FIG. 9 is an exploded perspective view of the skeletal member of FIG. 7.

Additionally, the draw handle 125 of the transport structure 16 is provided to the vertical frame 26 of the skeletal member 11. Specifically, the draw handle 125 is swingably supported in the vertical direction at the upper center section 26*a* of the vertical frame 26 via a handle support section 128. The handle support section 128 is fastened together with the center frame 27 by a plurality of bolts 129 in the upper center section 26*a* of the vertical frame 26. The handle support section 128 is shown in FIG. 9.

The transport structure 16 is provided with left and right wheels 31, 32, the rear stationary handle 118, a front stationary handle 119 (see FIGS. 1 and 2), and the draw handle 125. The front stationary handle 119 is provided so as to cover a support shaft 131 of the draw handle 125, as shown in FIG. 2.

In accordance with the transport structure 16, the draw handle 125 is swung upward about the support shaft 131 to a draw position (the state shown in FIG. 5), a grip 132 of the draw handle 125 is gripped, and the engine generator is pulled. In other words, gripping and lifting the grip 132 causes the left and right leg sections 29 to be lifted off the ground (road surface). Pulling the grip 132 in this state enables the left and right wheels 31, 32 to rotate and the engine generator 10 to be moved (transported).

The draw handle 125 swings downward about the support shaft 131 and the draw handle 125 is secured to the front case section 46 (FIG. 1). In this state, the rear stationary handle 118 and the front stationary handle 119 are gripped, and the engine generator 10 is lifted and transported.

Figure 7:
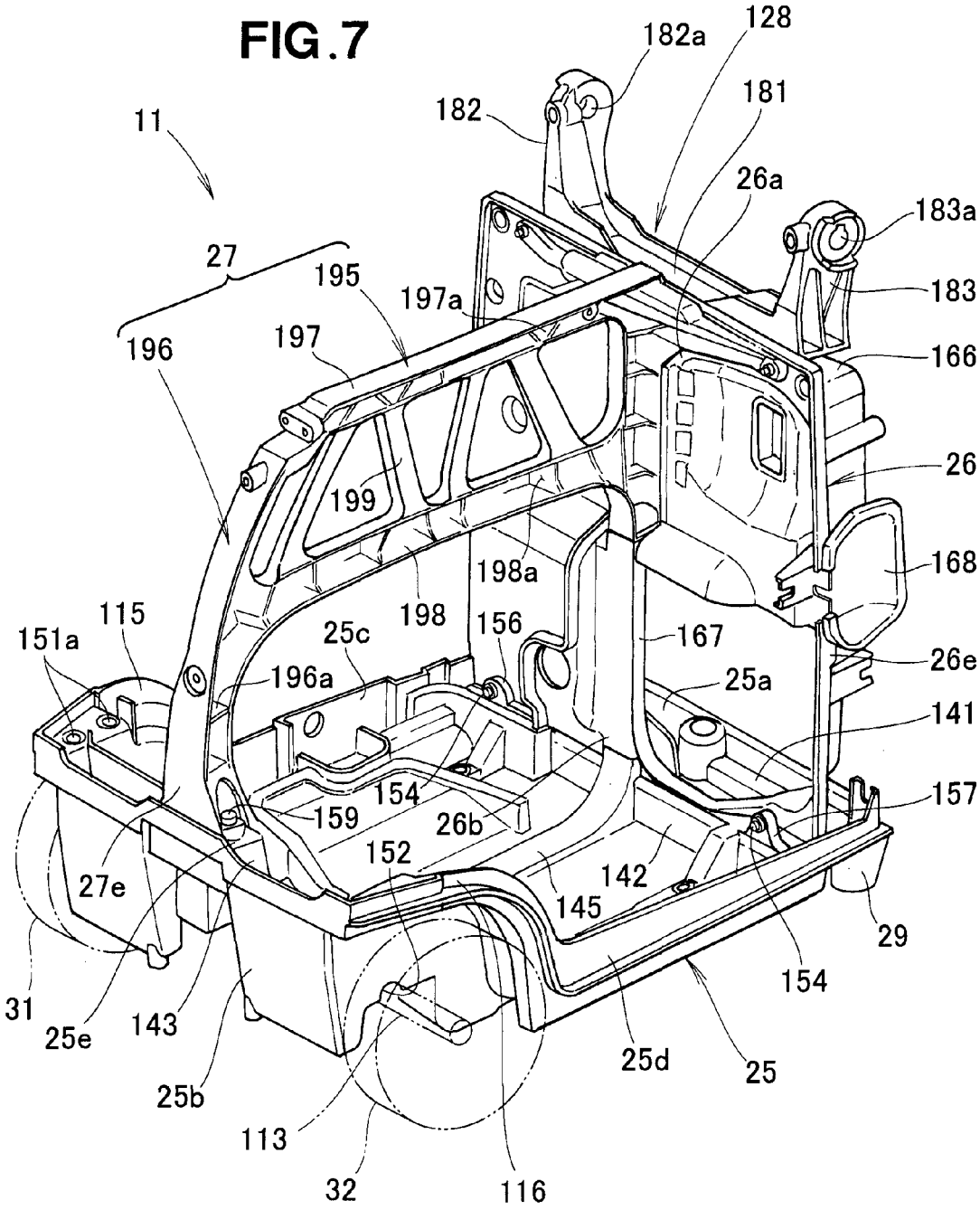
FIG. 7 is a perspective view showing a skeletal member of FIG. 6.
Figure 8:
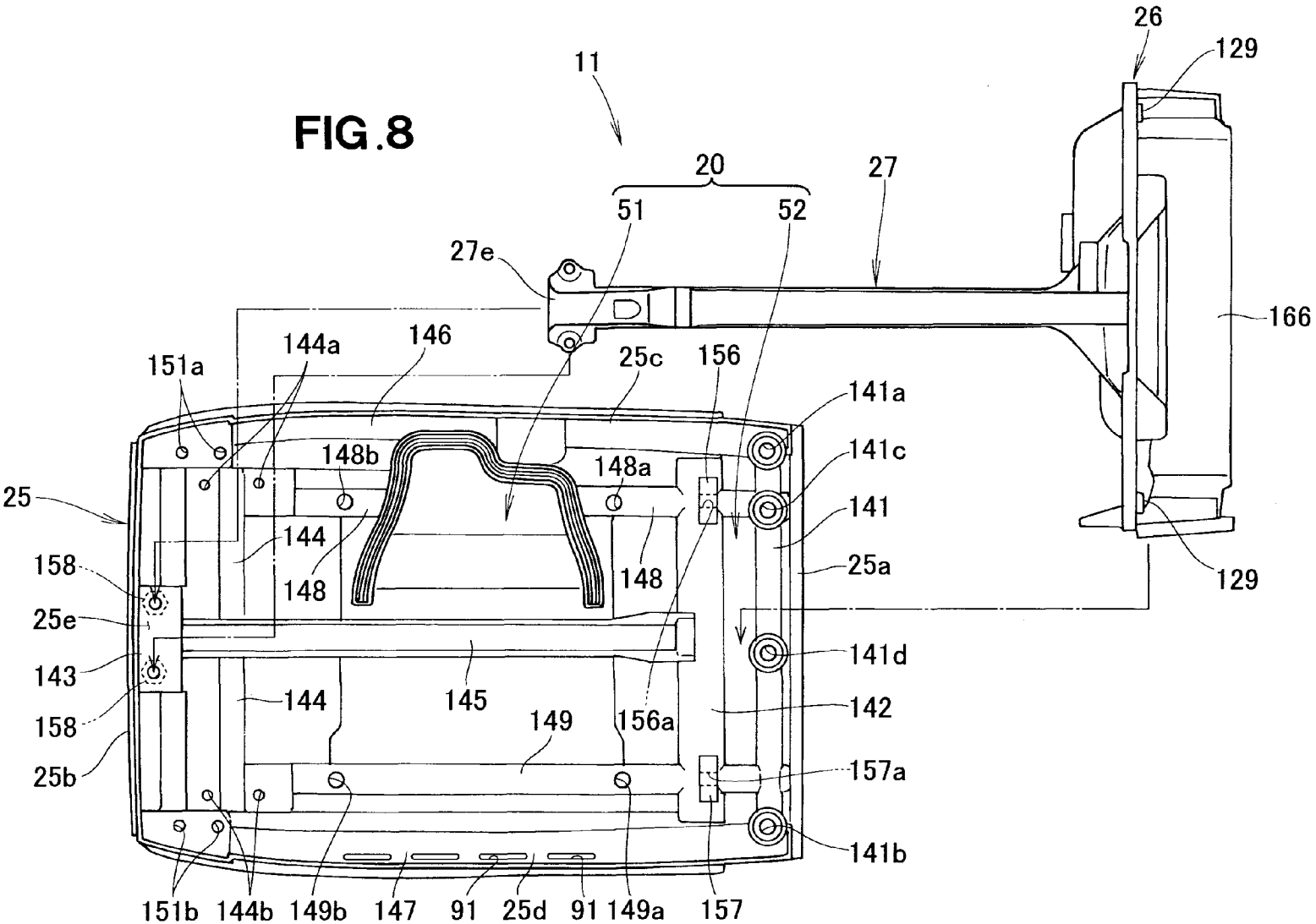
FIG. 8 is a top plan view of the skeletal member with a bottom cover disassembled from the member.

The bottom cover 25 of the skeletal member 11 is composed of the bottom section of the skeletal member 11, as shown in FIGS. 7 and 8. The bottom cover 25 is composed of a high-rigidity resin formed substantially in a rectangular shape by the front-end section 25*a*, the rear-end section 25*b*, the left side section 25*c*, and the right side section 25*d*. The bottom cover 25 can be made thinner and lighter in weight by forming the bottom cover 25 from a high-rigidity resin.

The bottom cover 25 is provided with a front lateral rib 141 disposed along the front-end section 25*a*, a front vicinity lateral rib 142 disposed toward the rear (i.e., near the front-end section 25*a*) of the front lateral rib 141, a rear lateral rib 143 disposed in the center section of the rear-end section 25*b*, a shaft lateral rib 144 disposed toward the front (i.e., near the rear-end section 25*b*) of the rear lateral rib 143, a center longitudinal rib 145 disposed so as to be perpendicular to the shaft lateral rib 144, left and right longitudinal ribs 146, 147 provided to the left and right side sections 25*c*, 25*d*, respectively, a left vicinity longitudinal rib 148 provided toward the center of the left side section 25*c* (i.e., near the left side section 25*c*), and a right vicinity longitudinal rib 149 provided toward the center of the right side section 25*d* (i.e., near the right side section 25*d*).

The shaft lateral rib 144 has on the bottom surface of the bottom cover 25 an accommodation recess 152 for accommodating the shaft 113 of the left and right wheels 31, 32.

The center longitudinal rib 145 is disposed so as to be perpendicular to the shaft lateral rib 144. The center longitudinal rib 145 extends from the rear end center section (other-end center section) 25*e* of the bottom cover 25 to the front-end section (one end section) 25*a*.

The front lateral rib 141, the front vicinity lateral rib 142, the rear lateral rib 143, and the shaft lateral rib 144 are reinforcement ribs that bulge upward so as to be formed substantially in an inverted U-shape in cross section.

The center longitudinal rib 145, the left longitudinal rib 146, the right longitudinal rib 147, the left vicinity longitudinal rib 148, and the right vicinity longitudinal rib 149 are reinforcement ribs that bulge upward so as to be formed substantially in an inverted U-shape in cross section.

As described above, the rigidity of the bottom cover 25 is increased by providing the bottom cover 25 with the front lateral rib 141, the front vicinity lateral rib 142, the rear lateral rib 143, the shaft lateral rib 144, the center longitudinal rib 145, the left longitudinal rib 146, the right longitudinal rib 147, the left vicinity longitudinal rib 148, and the right vicinity longitudinal rib 149.

The front lateral rib 141 has mounting holes 141*a*, 141*b* formed in the left and right end sections. The left and right leg sections 29 are mounted using bolts (not shown) in the left and right mounting holes 141*a*, 141*b*.

A pair of mounting holes 141*c*, 141*d* is formed in the front lateral rib 141 between the left and right mounting holes 141*a*, 141*b*. The inverter unit 78 (see FIG. 2) is mounted using bolts (not shown) in the pair of mounting holes 141*c*, 141*d*.

The front vicinity lateral rib 142 has left and right frame support sections 156, 157 that protrude upward on the left and right end sections. The mounting holes 156*a*, 157*a* for mounting the lower end section 26*b* on the vertical frame 26 are formed in the left and right frame support sections 156, 157, respectively. A lower end section 26*b* of the vertical frame 26 is mounted using bolts 154, 154 in left and right mounting holes 156*a*, 157*a*.

The rear lateral rib 143 has a center support section, i.e., the rear end center section 25*e* provided to the upper end section. A pair of nuts 158 is insert-molded in the rear end center section 25*e*. A rear end lower section 27*e* of the center frame 27 is mounted using bolts 159 in the pair of nuts 158.

The shaft lateral rib 144 has left and right mounting holes 144*a* 144*b* formed in the left and right end sections. A left support bearing 211 (see FIG. 6) is fastened using bolts to the left mounting holes 144*a*, a right support bearing 212 (see FIG. 6) is fastened using bolts to the right mounting holes 144*b*. Accordingly, the shaft 113 (see FIG. 6) of the left and right wheels 31, 32 is mounted in the accommodation recess 152 using the left and right support bearings 211, 212.

Mounting holes 151*a* for mounting the left handle mounting section 121 is formed on the outer side of the left mounting holes 144*a*, i.e., in the left side section of the rear-end part 25*b*.

Mounting holes 151*b* for mounting the right handle mounting section 122 is formed on the outer side of the right mounting holes 144*b*, i.e., in the right side section of the rear-end part 25*b*.

The left and right handle mounting sections 121, 122 (see FIG. 6) are mounted using bolts (not shown) in the left and right mounting holes 151*a*, 151*b*.

The left vicinity longitudinal rib 148 has mounting holes 148*a*, 148*b* formed in the front and rear left side. The right vicinity longitudinal rib 149 has mounting holes 149*a*, 149*b* formed in the front and rear right side. The four mounting members 33 (see FIG. 2) are mounted using bolts 163 (see FIG. 10) in the left vicinity longitudinal rib 148 and the right vicinity longitudinal rib via the front and rear left side mounting holes 148*a*, 148*b* and the front and rear right side mounting holes 149*a*, 149*b*, respectively.

The four mounting members 33 are mounted on the leg mount section 37 of the engine/generator unit 12 using bolts 164, as shown in FIG. 10. The engine/generator unit 12 (see FIG. 2) is supported by the left and right vicinity longitudinal ribs 148, 149 via the mounting members 33.

FIG. 9 shows an exploded view of the skeletal member 11. The vertical frame 26 is disposed along the front vicinity lateral rib 142 of the bottom cover 25. The vertical frame 26 is formed in a substantially rectangular wall shape using high-rigidity resin, and the width dimension W is formed to substantially the same width as the bottom cover 25. The vertical frame 26 can be made thinner and more lightweight by forming the vertical frame 26 from a high-rigidity resin.

Left and right end sections (two end sections) 26*c*, 26*d* are in contact with the left and right frame support sections 156, 157 in the lower end section 26*b* of the vertical frame 26. A mounting hole 161 of the left end section 26*c* is coaxially positioned with the mounting hole 156*a* of the left frame support section 156. A mounting hole 162 of the right end section 26*d* is coaxially positioned with the mounting hole 157*a* of the right frame support section 157

The left end section 26*c* of the vertical frame 26 is mounted on the left frame support section 156 using a bolt 154. The right end section 26*d* of the vertical frame 26 is mounted on the right frame support section 157 using a bolt 154. The vertical frame 26 is erectly disposed so as to be lateral along lengthwise direction of the front vicinity lateral rib 142 of the bottom cover 25. Therefore, the vertical frame 26 can be securely mounted on the bottom cover 25.

In this manner, the vertical frame 26 is formed in the shape of a wall having a width dimension W, and the vertical frame 26 is laterally mounted on the bottom cover 25, whereby the vertical frame 26 can be prevented from toppling in the surface direction (lateral direction).

Formed on the vertical frame 26 are a visor section 166 that protrudes forward from the front surface below the upper center section 26*a*, an opening 167 formed in a right lower location, and a knob accommodation section 168 formed in a right side section 26*e*.

A control panel 79 of the electrical component section 13, an inverter unit 78 (see FIG. 4), and the like are mounted on the front surface of the vertical frame 26 below the visor section 166.

The opening 167 of the vertical frame 26 is an opening for accommodating the rear section of the inverter unit 78 and directing to the cooling fan 85 (see FIG. 4) outside air (cooling air) brought into the case 17 shown in FIG. 4.

The electrical component section 13 shown in FIGS. 2 and 4 controls the output of the engine/generator unit 12, is provided with the control panel 79 in the upper half section, and is provided with the inverter unit 78 in the lower half section. A switch for starting the engine, and an AC terminal, a DC terminal, or the like for outputting generated power is provided to the control panel 79 so as to face outward from an opening 48 in the front case section 46. The inverter unit 78 controls the output frequency of the generator 22.

The knob accommodation section 168 is a recess for accommodating a pull knob 112 of the recoil starter 111 shown in FIG. 4. The pull knob 112 is connected to a wire 114 (see FIG. 4). The recoil starter 111 is operated by pulling the wire 114 using the pull knob 112 when the engine 21 is to be started.

Left and right inner mounting holes 171, 172 are formed in the vertical frame 26 toward the upper center section 26*a*, a left outer mounting hole 173 is formed outward from the left inner mounting hole 171, a right outer mounting hole 174 is formed outward from right inner mounting holes 172, and a center mounting hole 175 is formed substantially in the center of the vertical frame 26. A front-end section 27*b* of the center frame 27 is mounted together with the handle support section 128 in the left and right inner mounting holes 171, 172, the left and right outer mounting holes 173, 174, and the center mounting hole 175.

The handle support section 128 has a base section 181 that extends in the lateral direction, and the left and right bracket parts 182, 183 erectly provided from the left and right ends of the base section 181. Left and right inner mounting holes 185, 186 are formed in the base section 181 coaxially with the left and right inner mounting holes 171, 172 of the vertical frame 26, and left and right outer mounting holes 187, 188 are formed coaxially with the left and right outer mounting holes 173, 174 of the vertical frame 26. Left and right support holes 182*a*, 183*a* are formed in the left and right bracket parts 182, 183, respectively. A support shaft 131 (see FIG. 5) of the draw handle 125 is inserted into and supported by the left and right support holes 182*a*, 183*a*. Accordingly, the draw handle 125 shown in FIG. 5 is swingably supported in the vertical direction via the handle support section 128 in the upper center section 26*a* of the vertical frame 26.

The center frame 27 is a backbone member (spine member) formed using an aluminum material, and has a frame beam section 195 mounted on the vertical frame 26 and a frame leg section 196 provided to a distal end 195*a* of the frame beam section 195 and mounted on the bottom cover 25.

The frame beam section 195 is provided with a beam section 197 that extends rearward from the upper end of the front-end section 27*b*, a lower beam section 198 that extends rearward from the lower end of the front-end section 27*b*, and a plurality of cross-parts 199 that are sloped and extend between the upper beam section 197 and the lower beam section 198.

The upper and lower beam sections 197, 198 are each formed in a U-shape in cross section and are reinforced by ribs 197*a*, 198*a*. The cross-parts 199 are formed in a U-shape in cross section. The frame beam section 195 can thereby be made more lightweight and the rigidity of the frame beam section 195 can be assured.

The frame leg section 196 is formed in a U-shape in cross section and is reinforced by a rib 196*a*. The frame leg section 196 can thereby be made more lightweight and the rigidity of the frame leg section 196 can be assured.

The center frame 27 is formed using an aluminum material, and the frame beam section 195 and the frame leg section 196 are formed in a U-shape in cross section, whereby the center frame 27 can be made more lightweight and the rigidity can be assured.

The frame beam section 195 extends horizontally along the bottom cover 25 from the upper center section 26*a* of the vertical frame 26 to the rear end center section 25*e* of the bottom cover 25.

The frame leg section 196 extends downward from the distal end 195*a* of the frame beam section 195 and the rear end center section 25*e* of the bottom cover 25 is mounted on the rear end center section 25*e*.

The center frame 27 is formed in an L shape by the frame beam section 195 and the frame leg section 196.

As described above, the center frame 27 is formed substantially in an L shape by the frame beam section 195 and the frame leg section 196, and the frame leg section 196 is disposed between the rear end center section 25*e* of the bottom cover 25 and the distal end 195*a* of the frame beam section 195. Accordingly, the frame beam section 195 is disposed in a relatively high position above the engine/generator unit 12 (see FIG. 6). A space 200 for disposing the engine/generator unit 12 below the frame beam section 195 can be readily assured.

The front-end section 27*b* of the center frame 27 is formed in a T shape by a front horizontal section 27*c* and a front perpendicular section 27*d*.

Nuts (not shown) are insert-molded in the front horizontal section 27*c* coaxially with the left and right inner mounting holes 171, 172 of the vertical frame 26, and left and right mounting holes 201, 202 are formed coaxially with the left and right outer mounting holes 173, 174 of the vertical frame 26.

The nuts (not shown) are insert-molded in the front perpendicular section 27*d* coaxially with the center mounting hole 175 of the vertical frame 26.

The front horizontal section 27*c* of the front-end section 27*b* of the center frame 27 is fastened together with the handle support section 128 using a bolt 129 in the upper center section 26*a* of the vertical frame 26. The front-end section 27*b* of the center frame 27 is fastened using a bolt 129 to the center mounting hole 175 formed substantially in the center of the vertical frame 26.

The rear end lower section 27*e* of the center frame 27 is mounted on the rear end center section 25*e* of the bottom cover 25. A pair of mounting holes 206, 206 is formed in the rear end lower section 27*e* coaxially with the pair of nuts 158 (see FIG. 8), respectively, of the rear end center section 25*e*. The rear end lower section 27*e* of the center frame 27 is mounted using bolts 159, 159 on the rear end center section 25*e* of the bottom cover 25. The center frame 27 is thereby suspended between the upper center section 26*a* of the vertical frame 26 and the rear end center section 25*e* of the bottom cover 25 (see FIG. 7). Therefore, the vertical frame 26 and the center frame 27 are formed in a T shape as viewed from above (see FIG. 8). Accordingly, the center frame 27 can prevent the vertical frame 26 from toppling in the direction perpendicular to the surface. Additionally, as described above, the vertical frame 26 can be prevented from toppling in the surface direction by forming the width dimension W of the vertical frame 26 to be substantially the same width as the bottom cover 25. A highly rigid skeletal member 11 can thereby be formed using the bottom cover 25, the vertical frame 26, and the center frame 27; i.e., three members. The bottom cover 25 and the vertical frame 26 can be formed from a high-rigidity resin and made thinner, and the center frame 27 can be formed from an aluminum member and endowed with high rigidity, whereby the rigidity of the skeletal member 11 is assured and the skeletal member 11 can be made more lightweight. The rigidity of the case 17 can be reduced by supporting the case 17 with the highly rigid skeletal member 11. Accordingly, the case 17 can be made more lightweight by forming the case 17 with polypropylene (PP) or another resin in place of steel.

In this manner, the rigidity of the engine generator 10 can be assured while making the engine generator 10 less heavy by reducing the weight of the skeletal member 11 and the weight of the case 17.

The handle support section 128 can be securely fixed by mounting the handle support section 128 on the vertical frame 26 of the highly rigid skeletal member 11. The draw handle 125 can be securely mounted by supporting the support shaft 131 (see FIG. 5) of the draw handle 125 using the handle support section 128.

The accommodation space 20 in the case 17 shown in FIG. 4 is partitioned by the vertical frame 26 into the unit accommodation area 51 and the electrical component section accommodation area 52 by erectly disposing the vertical frame 26 on the front vicinity lateral rib 142 of the bottom cover 25, as shown in FIGS. 7 and 8. The accommodation space 20 is a space covered by the bottom cover 25 and the case 17. The unit accommodation area 51 is a space in the accommodation space 20 and is used for accommodating the engine/generator unit 12 (see FIG. 6). The electrical component section accommodation area 52 is a space in the accommodation space 20 and is used for accommodating the electrical component section 13 (see FIG. 4).

In this manner, the electrical component section 13 can be kept at an optimal environment temperature by using the vertical frame 26 to partition the accommodation space 20 into the unit accommodation area 51 and the electrical component section accommodation area 52. Since the vertical frame 26 can also double as a partition wall, a partition wall for partitioning the unit accommodation area 51 and the electrical component section accommodation area 52 is not required to be separately provided. The number of components can thereby be reduced and the configuration can be made more lightweight.

The shaft lateral rib 144 of the bottom cover 25 is provided forward of the rear lateral rib 143 (i.e., near the rear-end part 25*b*) and bulges upward as a reinforcement formed in an inverted U-shape in cross section, as shown in FIG. 10. The shaft lateral rib 144 is formed in an inverted U-shape in cross section, whereby the shaft lateral rib 144 is provided with the accommodation recess 152 for accommodating the shaft 113 disposed in the bottom surface of the bottom cover 25.

The shaft 113 is supported by the left and right support bearings 211, 212 (the left-side support bearing 211 is shown in FIG. 6) with the shaft 113 accommodated in the accommodation recess 152. The left and right support bearings 211, 212 are mounted on the bottom surface of the bottom cover 25 using a plurality of bolts 204. The left and right wheels 31, 32 (the left wheel 31 is shown in FIG. 6) are rotatably mounted on the left and right ends, respectively, of the shaft 113.

The left and right wheels 31, 32 of the transport structure 16 are disposed in the wheel accommodation space 38 by providing the wheel accommodation space 38 below the cylinder block 35 of the engine 21, as shown in FIG. 2. Accordingly, the left and right wheels 31, 32 can be upwardly disposed (i.e., in a high position). The shaft 113 can thereby be disposed above the mounting members 33 of the engine/generator unit 12. Specifically, the height H2 of the shaft 113 is set to be greater (higher) than the height H3 of the mounting members 33. Disposing the left and right wheels 31, 32 in the wheel accommodation space 38 thus allows them to be upwardly disposed (in a high position). The engine generator 10 can thereby made even more compact.

The center frame 27 is disposed in the unit accommodation area 51, above the engine/generator unit 12 and substantially in the center in the lateral direction, as shown in FIG. 3. The engine/generator unit 12 is configured so that the drive shaft 34 of the engine 21 is provided perpendicular to the center frame 27.

The engine 21 is disposed on the left side (one side) of the center frame 27, and the generator 22 is disposed on the right side (other side) of the center frame 27.

The insulating member 18 is provided to the left side of the center frame 27. The insulating member 18 partitions the unit accommodation area 51 into a hot area 54 of the side in which the engine 21 is disposed, and a cool area 53 of the side in which the generator 22 is disposed. An elastic seal member 215 (see FIG. 5) is provided to the entire periphery of the boundary section 24 of the engine 21 and the generator 22 of the engine/generator unit 12. The elastic seal member 215 partitions the hot area 54 and the cool area 53.

Having the insulating member 18 provided to the center frame 27 thus allows the unit accommodation area 51 to be partitioned by the insulating member 18 into the hot area 54 and the cool area 53. In other words, the heat of the engine 21 accommodated in the hot area 54 is shielded, without being transferred to the cool area 53. Accordingly, the environment temperature of the generator 22 disposed in the cool area 53 can be kept in an optimal state. In this manner, the configuration of the insulating member 18 can be simplified and made more lightweight by using the center frame 27 to support the insulating member 18.

As described above, the engine/generator unit 12 has the generator 22 and the cooling fan 85 coaxially provided to the drive shaft (crankshaft) 34 of the engine 21, and the four mounting members 33 mounted on the bottom cover 25, as shown in FIGS. 11 and 12.

The engine/generator unit 12 is provided with a metal fan cover 391 for covering the cooling fan 85, support means 394 provided to the fan cover 391 and extending to the engine 21, a resin cover guide 392 fastened to the engine 21 together with the support means 394, and the elastic seal member 215 provided to the external periphery of the cover guide 392.

The metal fan cover 391 has a peripheral wall 396 formed along the external periphery of the cooling fan 85, an inner opening 397 (see FIG. 3) formed in an inner edge 396*a* of the peripheral wall 396, an outer wall 398 formed on an outer edge 396*b* of the peripheral wall 396, and an outer opening 399 formed in the outer wall 398. The fan cover 391 is made of aluminum.

The metal fan cover 391 has the mounting members 33, 33 mounted on a rear lower end section 391*a* and a front lower end section (not shown) using bolts 401, 401 (the bolt of the front lower end section is not shown). The rear lower end section 391*a* is symmetrical in the forward/rearward direction with the front lower end section (not shown). The fan cover 391 is supported on the bottom cover 25 via the mounting member 33 mounted on the rear lower end section 391*a* and the mounting member 33 mounted on the front lower end section.

Specifically, the mounting members 33 mounted on the rear lower end section 391*a* is mounted on a rear-end section 149*a* of the right reinforcement rib 149 using a bolt 402. The right reinforcement rib 149 is provided in the vicinity of the right end of the bottom cover 25. The mounting member 33 mounted on the front lower end section is mounted on a front-end section 149*b* of the right vicinity longitudinal rib 149 using a bolt 402. The remaining two mounting members 33, 33 are mounted on the bottom section 56*a* of the crankcase 56 using the bolts 401, 401. Specifically, the remaining two mounting members 33, 33 are mounted on a front mounting section 414 (see FIG. 18) and a rear mounting section 415 of the bottom section 56*a*.

Figure 18:
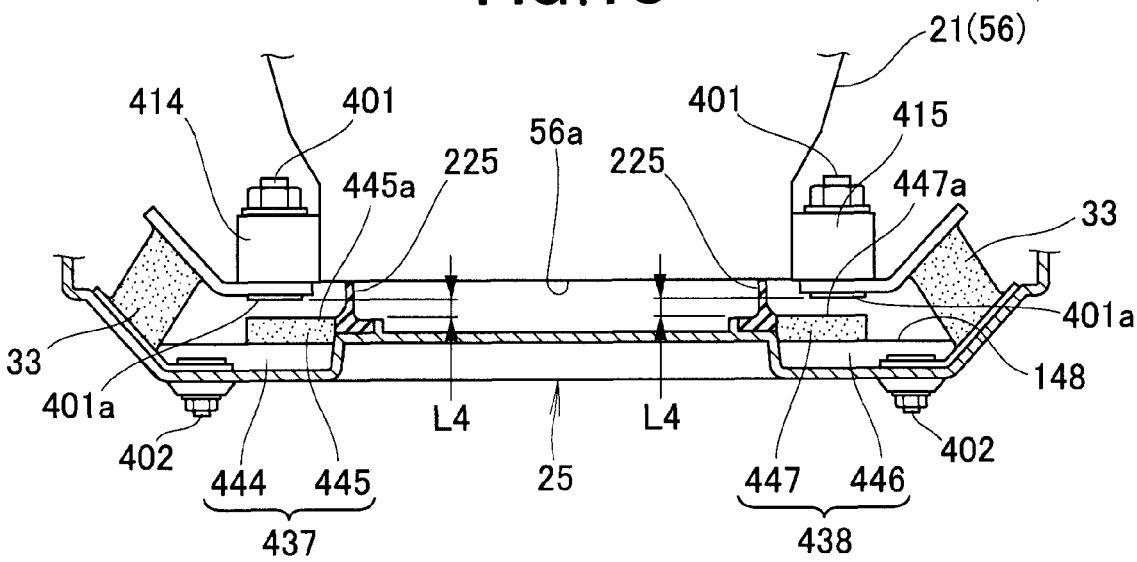
FIG. 18 a cross-sectional view showing a bottom front bump stopper and a bottom rear bump stopper of the engine/generator unit according to the present invention.

The mounting member 33 mounted on the rear mounting section 415 is mounted on the rear end section of the left reinforcement rib 148 (see FIG. 18). The left reinforcement rib 148 is provided in the vicinity of the left side of the bottom cover 25. The mounting member 33 mounted on the front mounting section 414 is mounted on the front-end section of the left reinforcement rib 148 using the bolt 402 (see FIG. 12).

A recoil starter cover 404 is mounted on the outer wall 398 of the fan cover 391 using a plurality of bolts 405. The recoil starter 111 shown in FIG. 3 is mounted in the recoil starter cover 404.

The support means 394 has first to third support leg sections 406 to 408 for mounting the fan cover 391 on the engine 21. A base end 406*a* of the first support leg section 406 is provided to an upper location 396*c* of the inner edge 396*a* of the fan cover 391, and a distal end 406*b* is bolted onto an upper mounting section 411 of the engine 21 (crankcase 56). Specifically, the distal end 406*b* of the first support leg section 406 is fastened together with an upper center section 417*a* of the cover guide 392 to the upper mounting section 411 of the crankcase 56 using a bolt 412.

A base end 407*a* of the second support leg section 407 is provided to a rear lower location 396*d* of the inner edge 396*a* of the fan cover 391, and a distal end 407*b* is bolted to a rear mounting section 413 of the bottom section 56*a* of the engine 21 (crankcase 56). Specifically, the distal end 407*b* of the second support leg section. 407 is fastened together with a rear lower section 417*b* of the cover guide 392 using a bolt 412 to the rear mounting section 413 of the crankcase 56.

The third support leg section 408 is symmetrical in the forward/rearward direction with the second support leg section 407, a base end is provided to a front lower location of the inner edge 396*a* of the fan cover 391, and a distal end 408*b* is bolted to a front mounting section (not shown) of the bottom section 56*a* of the engine 21 (crankcase 56). Specifically the distal end 408*b* of the third support leg section 408 is fastened together with a front lower section 417*c* of the cover guide 392 using a bolt 412 to the front lower section of the crankcase 56.

The front mounting section of the crankcase 56 is symmetrical in the forward/rearward direction with the rear mounting section 413 of the crankcase 56.

A peripheral wall 416 of the resin cover guide 392 is formed along the external periphery of the generator 22. An outwardly projecting extended section 417 is formed on an inner edge 416*a* of the peripheral wall 416. A seal mounting section 418 on which the elastic seal member 215 is mounted is provided to the extended section 417.

An outer edge 416*b* of the peripheral wall 416 is formed (see FIG. 3) so as to be capable of conforming to the inner edge 396*a* of the fan cover 391 (peripheral wall 396).

The extended section 417 is a location extended outward from the front section, the rear section, and the upper section of the inner edge 416*a*.

The seal mounting section 418 is provided to an outer edge of the extended section 417 as well as to the lower section of the inner edge 416*a*. The elastic seal member 215 is mounted on the seal mounting section 418 (see FIG. 3).

The upper center section 417*a* of the extended section 417 is fastened together with the distal end 406*b* of the first support leg section 406 using a bolt 412. The rear lower section 417*b* of the extended section 417 is fastened together with the distal end 407*b* of the second support leg section 407 using a bolt 412. The front lower section 417*c* of the extended section 417 is fastened together with the distal end 408*b* of the third support leg section 408 using a bolt 412.

In this state, the cover guide 392 is disposed between the fan cover 391 and the engine 21, and the outer edge 416*b* of the peripheral wall 416 is superimposed on and fitted to the inner edge 396*a* of the fan cover 391 (peripheral wall 396). Accordingly, the cooling air sent from the cooling fan 85 can be guided to the engine 21 by the fan cover 391 and the cover guide 392 in the manner indicated by the arrow A, as shown in FIG. 3.

The cooling fan 85 is covered by the metal fan cover 391, and first to third support leg sections 406 to 408 are provided extending from the engine 21 to the fan cover 391, as shown in FIGS. 11 and 12. The first to third support leg sections 406 to 408 and the resin cover guide 392 are fastened together to the engine 21, and the metal fan cover 391 is supported on the bottom cover 25 via a plurality of mounting members 33. Accordingly, the weight of the engine/generator unit 12 can be supported by the first to third support leg sections 406 to 408 and the metal fan cover 391 without support from the resin cover guide 392. Since the weight of the engine/generator unit 12 is not required to be supported by the resin cover guide 392, the cover guide 392 can be formed using resin and rigidity can be sufficiently provided.

In this manner, the engine generator 10 can be made more lightweight by disposing the resin cover guide 392 between the metal fan cover 391 and the engine 21.

The resin cover guide 392 is disposed between the fan cover 391 and the engine 21. The cooling air sent from the cooling fan 85 is efficiently directed to the engine 21 by way of the fan cover 391 and the cover guide 392. The engine 21 is cooled with the cooling air thus directed.

The elastic seal member 215 is formed substantially in a pentagonal frame shape using, e.g., ethylene propylene rubber (EPDM). A stop 215*a* of the elastic seal member 215 is provided to the internal periphery, and a lip (tongue) 215*b* is provided to the external periphery (FIGS. 9 and 10). The stop 215*a* of the elastic seal member 215 is mounted on the seal mounting section 418. Accordingly, the elastic seal member 215 is provided to the external periphery of the cover guide 392.

The elastic seal member 215 is in contact with the bottom cover 25, the vertical frame 26, and an internal periphery 30 of the center frame 27 in a state which the lip 215*b* has elastically deformed (see FIGS. 2 and 3). Accordingly, the cooling air directed from the cover guide 392 to the engine 21 is prevented by the elastic seal member 215 from flowing back to the cover guide 392 from the engine 21. The cooling air sent from the cooling fan 85 can thereby be efficiently directed to the engine 21 and the engine 21 can be cooled by the cooling air thus directed.

The elastic seal member 215 has a harness clamp 409 provided to a rear end section 215*d* of the stop 215*a*, as shown in FIG. 12. The harness clamp 409 is formed so as to protrude from the rear end section 215*d* to the hot area 54.

Figure 13:
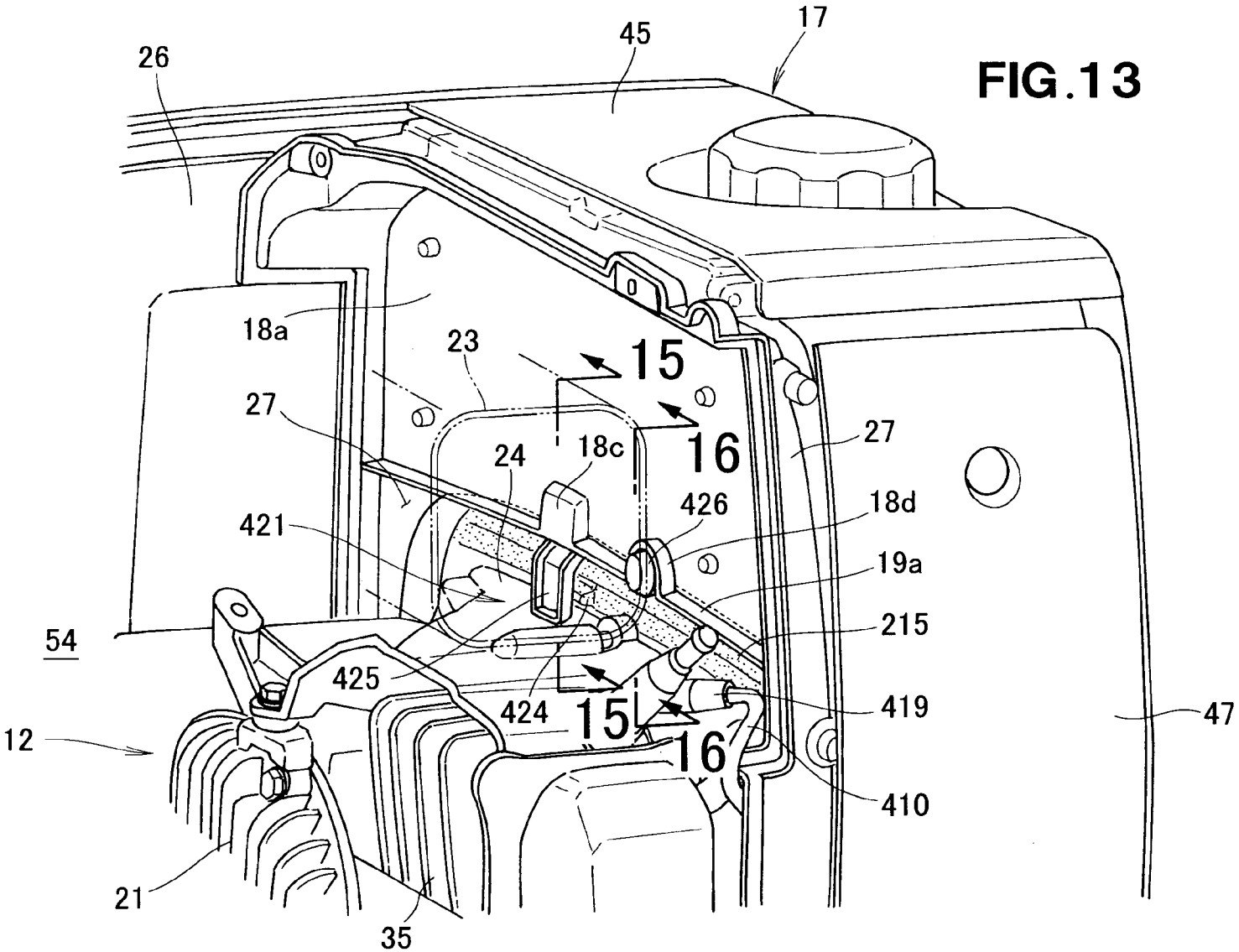
FIG. 13 is a perspective view of vibration suppressing means of the engine/generator unit.

A high-tension cord (plug cord) 410 is interlocked with the harness clamp 409. An ignition plug (spark plug) 419 is connected to an upper end of the high-tension cord 410, as shown in FIG. 13, while an ignition coil (spark coil) 420 is connected to a lower end of cord 410, as shown in FIG. 12. The number of members can be reduced by integrally forming the harness clamp 409 with the elastic seal member 215.

The elastic seal member 215 is provided between the center frame 27 and the engine/generator unit 12 and serves as a partition between the hot area (area) 54 accommodating the engine 21 and the cool area (area) 53 accommodating the generator 22, as shown in FIG. 3.

Figure 14:
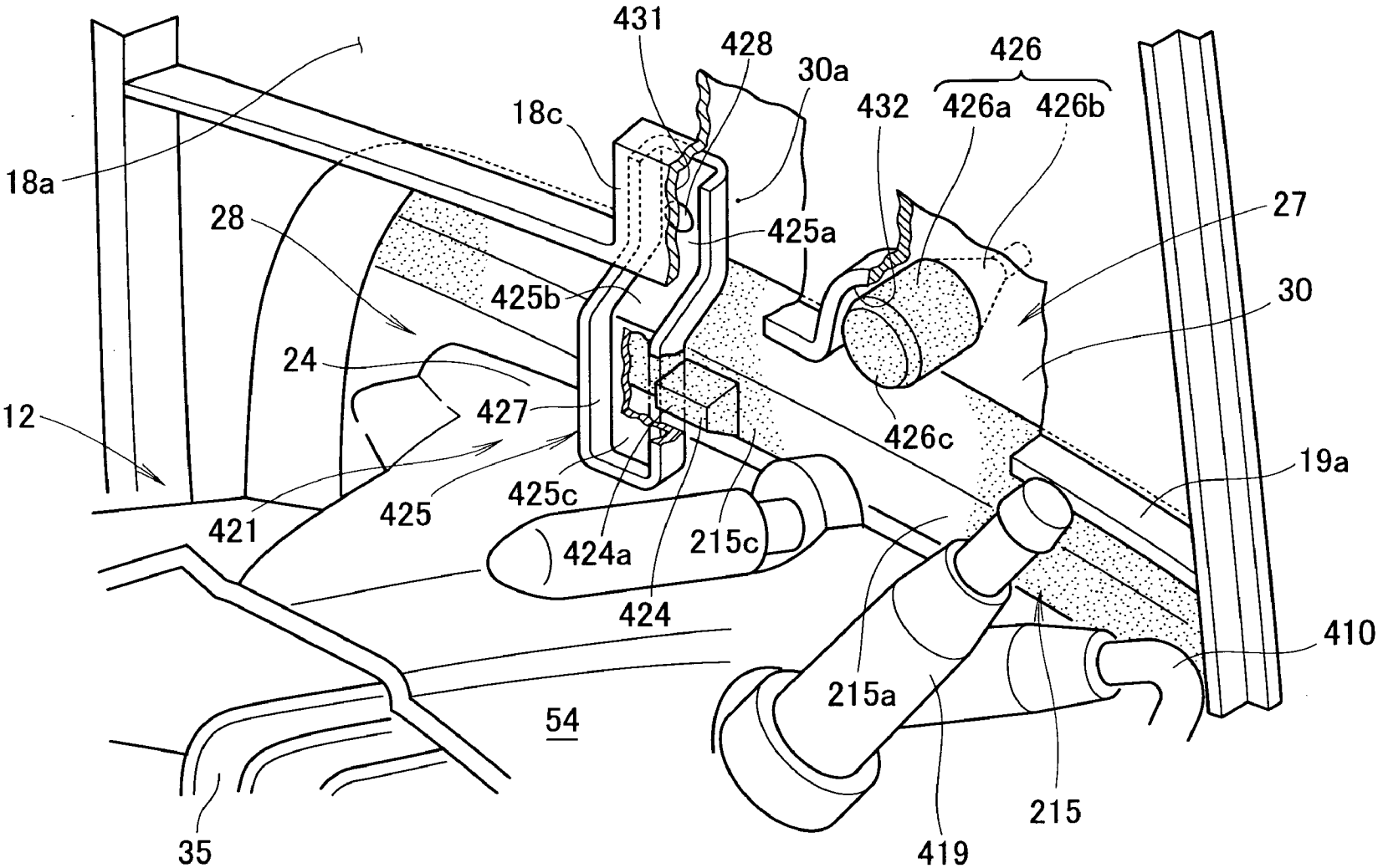
FIG. 14 is an enlarged view of the vibration suppressing means of FIG. 13.

In FIGS. 13 and 14, only a support panel 18*a* of the insulating member 18 is shown and an insulating body 18*b* (FIG. 15) is omitted in order to facilitating understanding of an upper vibration suppressing section 421.

The vibration suppressing means 28 is provided with the upper vibration suppressing section 421 disposed above the engine/generator unit 12, and a bottom vibration suppressing section 422 disposed below the engine/generator unit 12 (see FIG. 11).

The upper vibration suppressing section 421 will be described first.

The upper vibration suppressing section 421 is provided with an upper center bump stopper (center bump stopper) 424 integrally formed with the elastic seal member 215, an upper center bump seat section (bump seat section) 425 that is capable of making contact with the upper center bump stopper 424, and a muffler bump stopper 426 provided to the center frame 27.

The upper center bump stopper 424 is integrally formed with an upper center section 215*c* of the stop 215*a* of the elastic seal member 215 and protrudes from the upper center section 215*c* toward the hot area 54. The upper center bump stopper 424 is a location that is substantially rectangular in shape and has a flat distal end 424*a*.

An increase in the number of members can be minimized by integrally forming the upper center bump stopper 424 with the elastic seal member 215. The steps for assembling the upper center bump stopper 424 can thereby be reduced and productivity can be improved.

The elastic seal member 215 is provided between the center frame 27 and the engine/generator unit 12 (see FIG. 3). The center frame 27 is disposed above the center section 24 of the engine/generator unit 12. Accordingly, the upper center bump stopper 424 is disposed above the center section 24 of the engine/generator unit 12 by integrally forming the upper center bump stopper 424 with the upper center section 215*c* of the elastic seal member 215.

The center of gravity G of the engine/generator unit 12 is positioned substantially in the center of the engine/generator unit 12, as shown in FIGS. 2 and 3. The engine/generator unit 12 vibrates about the center of gravity G. Accordingly, the amount of vibration of the upper center bump stopper 424 brought closer to the center of gravity G can be reduced to a low level. The upper center bump stopper 424 can thereby reduce the load imparted by the vibrations. Therefore, the vibrations can be reduced with a more compact upper center bump stopper 424, and the engine-driven generator 10 can be made smaller.

Figure 15:
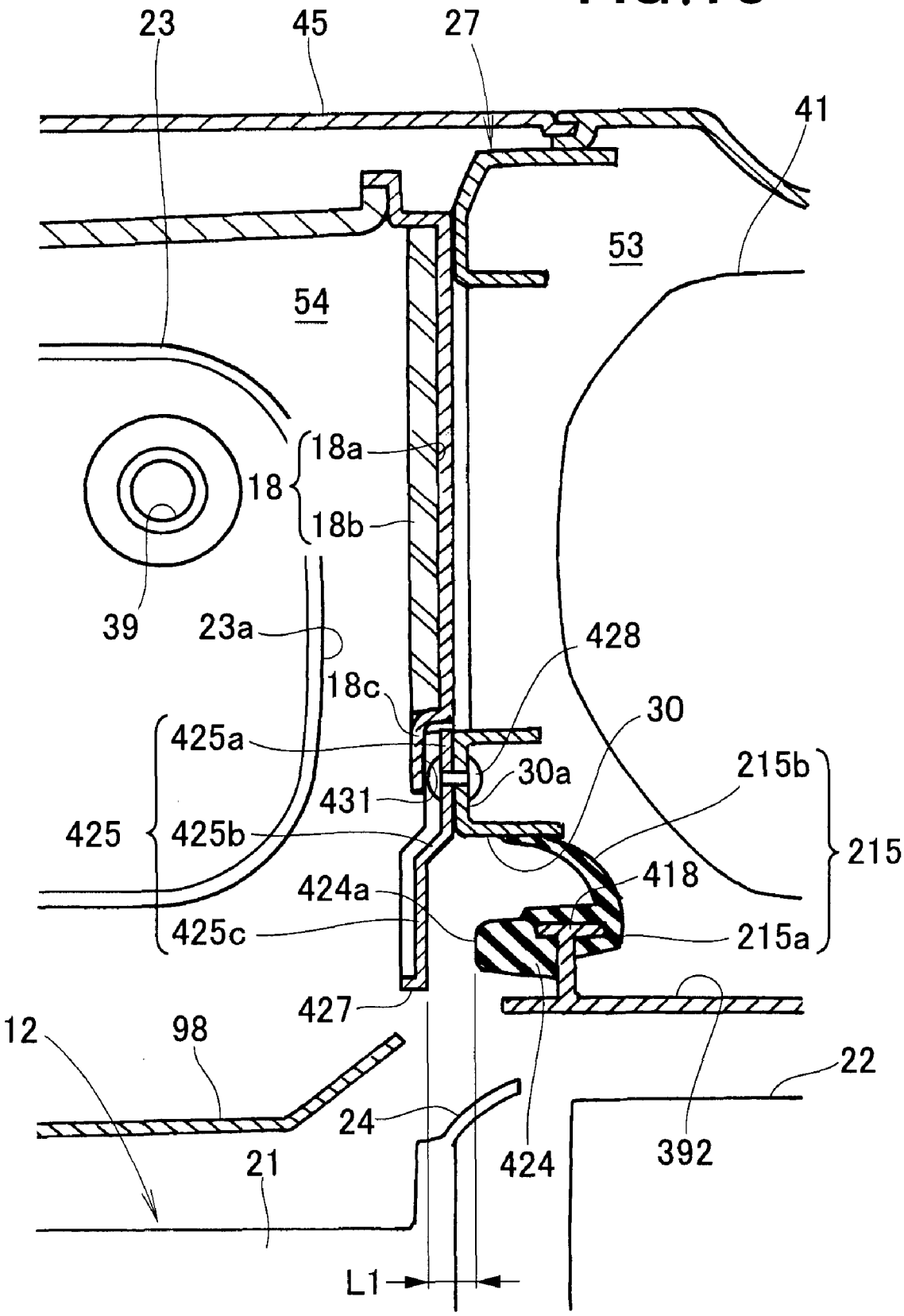
FIG. 15 is a cross-sectional view taken along line 15-15 of FIG. 13.

The upper center bump seat section 425 is formed by bend molding a substantially rectangular flat plate, for example, as shown in FIG. 15. In other words, the upper center bump seat section 425 has a reinforcement rib 427 formed along the periphery by mounting an upper half section 425*a* on a lower center section 30*a* of the center frame 27 using a fastening member (e.g., a rivet) 428, bending a center section 425*b* from the lower part of the upper half section 425*a* toward the hot area 54, and bending a lower half section 425*c* downward from the lower part of the center section 425*b* (see 14).

The upper half section 425*a* of the upper center bump seat section 425 must be prevented from interfering with the support panel 18*a* of the insulating member 18. Therefore, a lower section center 18*c* of the support panel 18*a* is made to protrude toward the hot area 54 (see FIGS. 13 and 14), and a recess 431 is formed in a location that corresponds to the upper half section 425*a*. Accordingly, the upper half section 425*a* of the upper center bump seat section 425 is accommodated in the recess 431, and the upper half section 425*a* is prevented from interfering with the support panel 18*a* of the insulating member 18.

The lower half section 425*c* is disposed in a position facing the distal end 424*a* of the upper center bump stopper 424 at a predetermined interval L1 away from the distal end 424*a*. The predetermined interval L1 is set so that the upper center bump stopper 424 can make contact with the lower half section 425*c* of the upper center bump seat section 425 when the engine/generator unit 12 vibrates.

Specifically, the predetermined interval L1 is set so as to allow the upper center bump stopper 424 to make contact with the lower half section 425*c* due to the horizontal component of the vibrations of the engine/generator unit 12. The predetermined interval L1 can be adjusted by modifying the bent state of the center section 425*b* of the upper center bump seat section 425.

The muffler bump stopper 426 has a stopper main body 426*a* that protrudes from a rear location (the lower center section 30*a* of the center frame 27) of the upper center bump seat section 425 toward the hot area 54, and a clip 426*b* provided to the base end of the stopper main body 426*a*.

The stopper main body 426*a* is a protruding part formed substantially in a circular shape in cross section using a rubber material that can elastically deform, and has a flat distal end 426*c*.

The stopper main body 426*a* of the muffler bump stopper 426 must be prevented from interfering with the support panel 18*a* of the insulating member 18. Therefore, a lower-side center 18*d* (see FIG. 13) of the support panel 18*a* is made to protrude upward, and a recess 432 is formed in a location that faces the stopper main body 426*a*. Accordingly, the stopper main body 426*a* is accommodated in the recess 432, and the stopper main body 426*a* is prevented from interfering with the support panel 18*a* of the insulating member 18.

Figure 16:
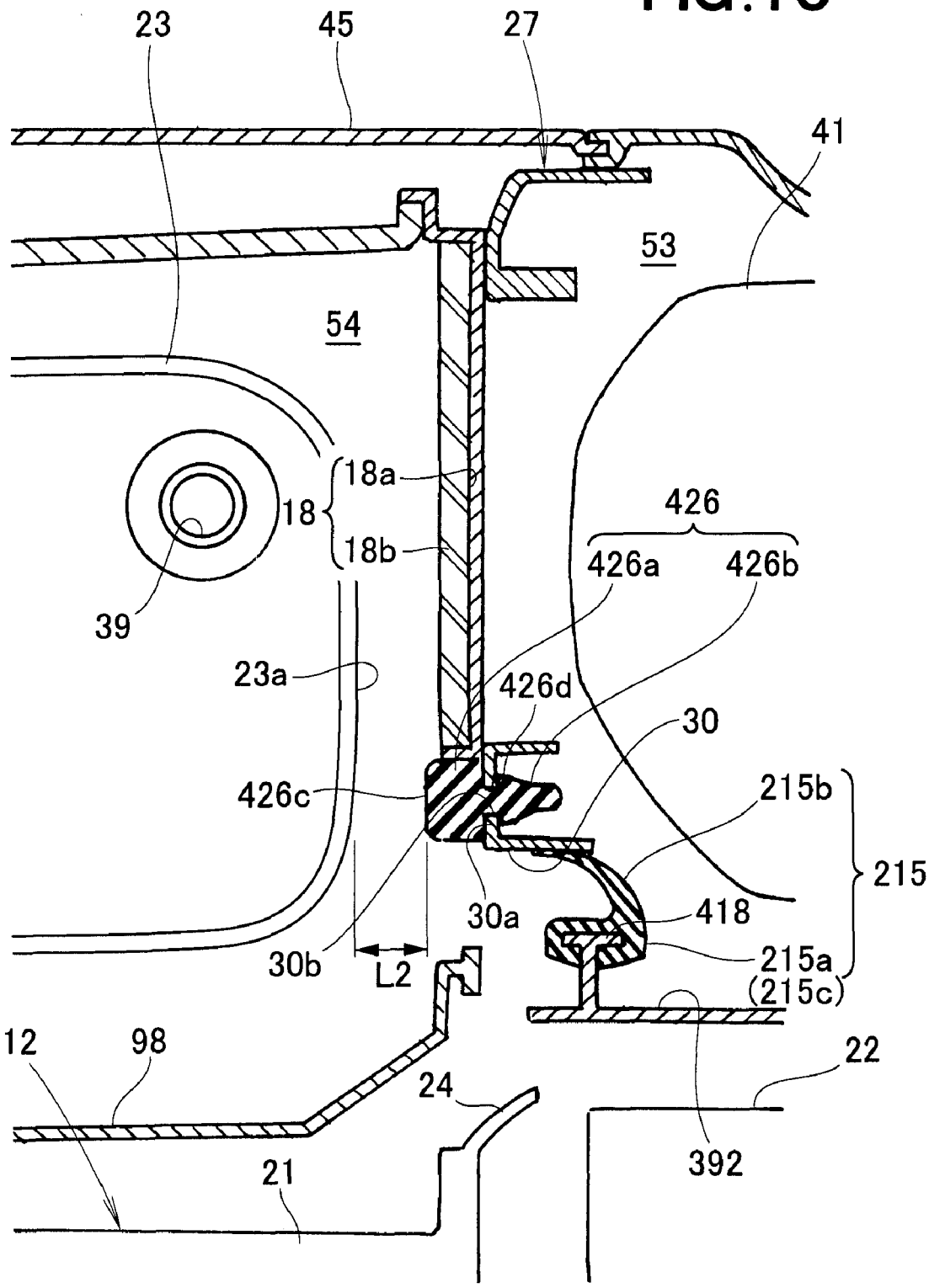
FIG. 16 is a cross-sectional view taken along line 16-16 of FIG. 13.

The clip 426*b* of the muffler bump stopper 426 is a fastening member for mounting the muffler bump stopper 426 on the center frame 27, as shown in FIG. 16. The muffler bump stopper 426 is mounted on the lower center section 30*a* of the center frame 27 by inserting the clip 426*b* into an interlocking hole 30*b* causing an interlocking pawl 426*d* of the clip 426*b* to interlock with the periphery of the interlocking hole 30*b*. Accordingly, the muffler bump stopper 426 is disposed above the center section 24 of the engine/generator unit 12 (see FIGS. 7 and 8).

The stopper main body 426*a* is positioned facing an inner wall 23*a* of the muffler 23 and is disposed at a predetermined interval L2 away from the inner wall 23*a*. The predetermined interval L2 is set so that the inner wall 23*a* of the muffler 23 can make contact with the muffler bump stopper 426 (the distal end 426*c* of the stopper main body 426*a*) when the engine/generator unit 12 vibrates.

Specifically, the predetermined interval L2 is set so as to allow the inner wall 23*a* of the muffler 23 to make contact with the distal end 426*c* of the muffler bump stopper 426 due to the horizontal component of the vibrations of the engine/generator unit 12.

The muffler bump stopper 426 is disposed above the center section 24 of the engine/generator unit 12 and can thereby be brought closer to the center of gravity G (see FIGS. 2 and 3) of the engine/generator unit 12. Accordingly, the amount of vibrations of the muffler bump stopper 426 can be reduced in the same fashion as the upper center bump stopper 424 (FIG. 15). The load placed on the muffler bump stopper 426 by the vibrations can thereby be reduced. Therefore, vibrations can be reduced with a more compact muffler bump stopper 426 and the engine-driven generator 10 can be made smaller.

The bottom vibration suppressing section 422 will be described next with reference to FIG. 11.

The bottom vibration suppressing section 422 has a bottom center bump stopper (bottom bump stopper) 435 provided to the right vicinity longitudinal rib 149 of the bottom cover 25, a bottom center bump seat section (bottom section of the engine/generator unit 12) 436 with which the bottom center bump stopper 435 can make contact (see FIG. 17), bottom front bump stopper (bottom bump stopper) 437 provided to the left reinforcement rib 148 of the bottom cover 25, and a bottom rear bump stopper (bottom bump stopper) 438.

A stopper support section 441 of the bottom center bump stopper 435 is formed substantially in the center of the right vicinity longitudinal rib 149, and a stopper main body 442 is provided to the stopper support section 441. The stopper main body 442 is a protruding part that protrudes upward from the stopper support section 441 and is formed substantially in an elliptical shape in cross section using a rubber material that can elastically deform. The stopper main body 442 has a flat upper end 442*a*.

Figure 17:
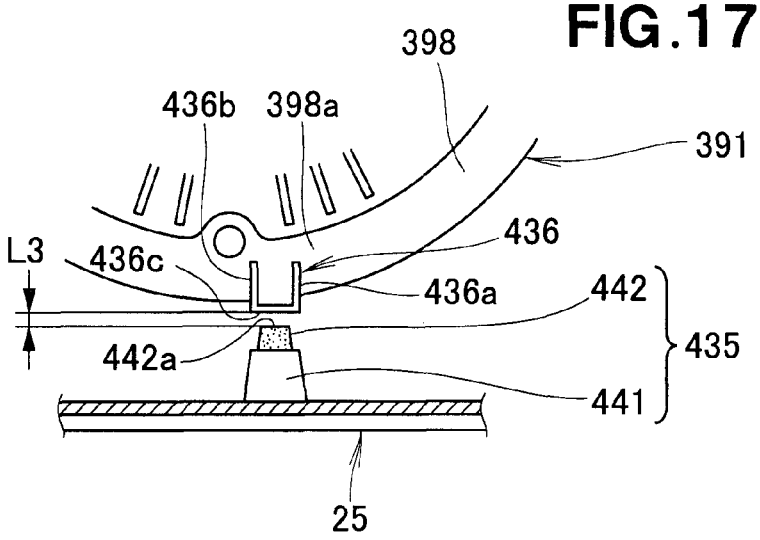
FIG. 17 is view showing a bottom center bump stopper of the engine/generator unit.

The bottom center bump seat section 436 is formed on a lower section 398*a* of the outer wall 398 of the fan cover 391, as shown in FIG. 17. The bottom center bump seat section 436 has front and rear wall sections 436*a*, 436*b* at a predetermined interval, and a bottom section 436*c* that extends between the lower ends of the front and rear wall sections 436*a*, 436*b*. The bottom center bump seat section 436 is formed substantially in a U-shape by the front and rear wall sections 436*a*, 436*b*, and the bottom section 436*c*.

The bottom section 436*c* of the bottom center bump seat section 436 is positioned facing the upper end 442*a* of the bottom center bump stopper 435 and at a predetermined interval L3 from the upper end 442*a*. The predetermined interval L3 can be set so that the bottom section 436*c* of the bottom center bump seat section 436 makes contact with the bottom center bump stopper 435 when the engine/generator unit 12 vibrates.

Specifically, the predetermined interval L3 is set so as to allow the bottom section 436*c* of the bottom center bump seat section 436 to make contact with the bottom center bump stopper 435 due to the vertical component of the vibrations of the engine/generator unit 12.

The bottom section 436*c* of the bottom center bump seat section 436 is provided to the outer wall 398 of the fan cover 391. The outer wall 398 of the fan cover 391 is provided to the right side section of the engine/generator unit 12 and is set relatively away from the center of gravity G (see FIGS. 2 and 3) of the engine/generator unit 12. For this reason, it is possible that the amount of vibration of the bottom section 436*c* of the bottom center bump seat section 436 will increase.

However, the vibrations of the engine/generator unit 12 are minimized by the upper vibration suppressing section 421, as described above. Therefore, the amount of vibrations of the bottom section 436*c* of the bottom center bump seat section 436 can be kept at a low level. The bottom center bump stopper 435 can thereby be made compact and the vibrations of the bottom section 436*c* of the bottom center bump seat section 436 can be sufficiently minimized.

A front stopper support section 444 of the bottom front bump stopper 437 is disposed in the vicinity of the front end of the left reinforcement rib 148, as shown in FIG. 18. A front stopper main body 445 is provided to the front stopper support section 444. The front stopper main body 445 protrudes upward from the front stopper support section 444 and has an upper end 445*a* that is formed flat.

The front stopper main body 445 is, e.g., a rubber material that can elastically deform and is integrally formed with a convex guide section 225. The convex guide section 225 directs cooling air sent by the cooling fan 85 shown in FIG. 3 in the manner indicated by the arrow B (see FIG. 11). The cooling air is directed along the bottom cover 25 to the cylinder block 35 by directing the cooling air in the manner indicated by the arrow B, as shown in FIG. 11.

The front stopper main body 445 is disposed in a position facing a head section (bottom section of the engine/generator unit 12) 401*a* of the bolt 401. The bolt 401 is used for mounting the mounting members 33 on the front mounting section 414 of the bottom section 56*a* of the crankcase 56.

The upper end 445*a* of the front stopper main body 445 is disposed at a predetermined interval L4 away from the head section 401*a* of the bolt 401. The predetermined interval L4 is set so as to allow the head section 401*a* of the bolt 401 to make contact with the bottom front bump stopper 437 when the engine/generator unit 12 vibrates.

Specifically, the predetermined interval L4 is set so as to allow the head section 401*a* of the bolt 401 to make contact with the bottom front bump stopper 437 due to the vertical component of the vibrations of the engine/generator unit 12.

The head section 401*a* of the bolt 401 mounted on the front mounting section 414 is provided to the exterior of the crankcase 56 (bottom section 56*a*). The exterior of the crankcase 56 (bottom section 56*a*) is disposed on the left side section of the engine/generator unit 12 and is therefore set relatively away from the center of gravity G (see FIGS. 2 and 3) of the engine/generator unit 12. For this reason, it is possible that the amount of vibration of the bolt 401 (the head section 401*a*) mounted on the front mounting section 414 will increase.

However, the vibrations of the engine/generator unit 12 are minimized by the upper vibration suppressing section 421, as described above. Therefore, the amount of vibrations of the bolt 401 (the head section 401*a*) can be kept at a low level. The bottom front bump stopper 437 can thereby be made compact and the vibrations of the bolt 401 (the head section 401*a*) can be sufficiently minimized.

The bottom rear bump stopper 438 is symmetrical in the forward/rearward direction with the bottom front bump stopper 437. In other words, the bottom rear bump stopper 438 has a rear stopper support section 446 provided in the vicinity of the rear end of the left reinforcement rib 148, and a rear stopper main body 447 provided to the rear stopper support section 446.

The rear stopper main body 447 protrudes upward from the rear stopper support section 446 and has an upper end section 447*a* that is formed flat. The rear stopper main body 447 is a rubber material that can elastically deform and is integrally formed with the convex guide section 225.

The rear stopper main body 447 is disposed in a position facing the head section (the bottom section of the engine/generator unit 12) 401*a* of the bolt 401. The bolt 401 is used for mounting the mounting members 33 on the rear mounting section 415 of the bottom section 56*a* of the crankcase 56.

The upper end section 447*a* of the rear stopper main body 447 is disposed at a predetermined interval L4 away from the head section 401*a* of the bolt 401. The predetermined interval L4 is set so as to allow the head section 401*a* of the bolt 401 to make contact with the bottom rear bump stopper 438 when the engine/generator unit 12 vibrates.

Specifically, the predetermined interval L4 is set so as to allow the head section 401*a* of the bolt 401 to make contact with the bottom rear bump stopper 438 due to the vertical component of the vibrations of the engine/generator unit 12.

The head section 401*a* of the bolt 401 mounted on the rear mounting section 415 is provided to the exterior of the crankcase 56 (bottom section 56*a*). The exterior of the crankcase 56 (bottom section 56*a*) is disposed on the left side section of the engine/generator unit 12 and is therefore set relatively away from the center of gravity G (see FIGS. 2 and 3) of the engine/generator unit 12. For this reason, it is possible that the amount of vibration of the bolt 401 (the head section 401*a*) mounted on the rear mounting section 415 will increase.

However, the vibrations of the engine/generator unit 12 are minimized by the upper vibration suppressing section 421, as described above. Therefore, the amount of vibrations of the bolt 401 (the head section 401*a*) can be kept at a low level. The bottom rear bump stopper 438 can thereby be made compact and the vibrations of the bolt 401 (the head section 401*a*) can be sufficiently minimized.

An example in which the vibrations of the engine/generator unit 12 are minimized using the vibration suppressing means 28 will be described next with reference to FIGS. 19 and 20.

Figure 19A:
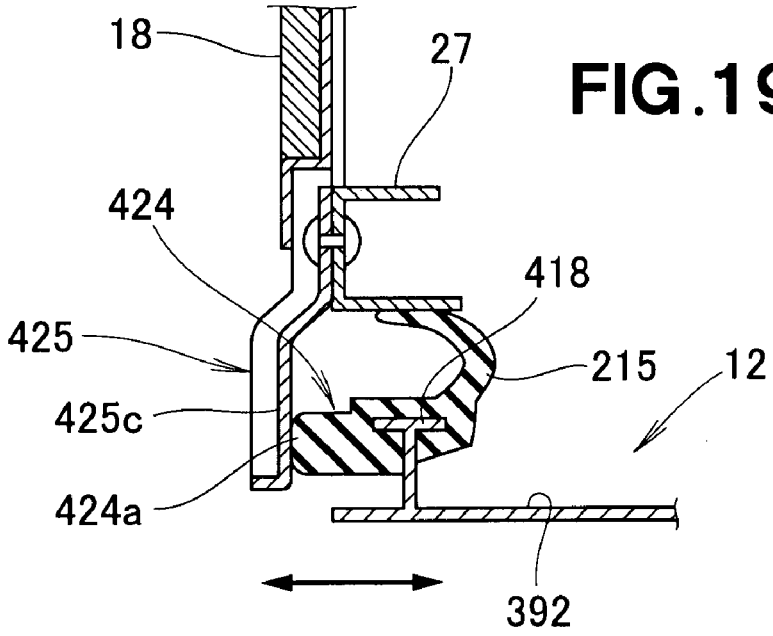
FIGS. 19A and 19B are cross-sectional views showing an example in which vibrations of the engine/generator unit are minimized with the aid of the upper vibration suppressing section.

In FIG. 19A, the upper center bump stopper 424 vibrates about the center of gravity G due to the vibrations of the engine/generator unit 12 about the center of gravity G (see FIGS. 2 and 3). The upper center bump stopper 424 vibrates in the direction of the arrow (the horizontal direction) due to the horizontal component of the vibrations. Accordingly, the upper center bump stopper 424 makes contact with the lower half section 425*c* of the upper center bump seat section 425 due to the horizontal component (component in the arrow direction) of the vibrations. The horizontal component of the vibrations is thereby minimized and the vibrations of the engine/generator unit 12 are minimized.

Figure 19B:
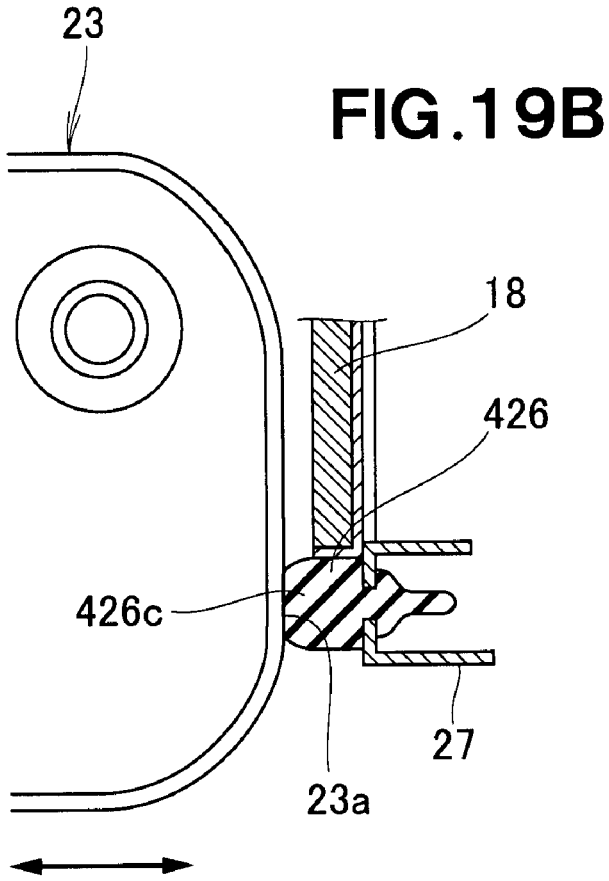

In FIG. 19B, the muffler 23 vibrates about the center of gravity G due to the vibrations of the engine/generator unit 12 about the center of gravity G (see FIGS. 2 and 3). The muffler 23 vibrates in the direction of the arrow (the horizontal direction) due to the horizontal component of the vibrations. Accordingly, the inner wall 23*a* of the muffler 23 makes contact with the distal end 426*c* of the muffler bump stopper 426 due to the horizontal component (the component in the arrow direction) of the vibrations. The horizontal component of the vibrations is thereby minimized and the vibrations of the engine/generator unit 12 are minimized.

Figure 20A:
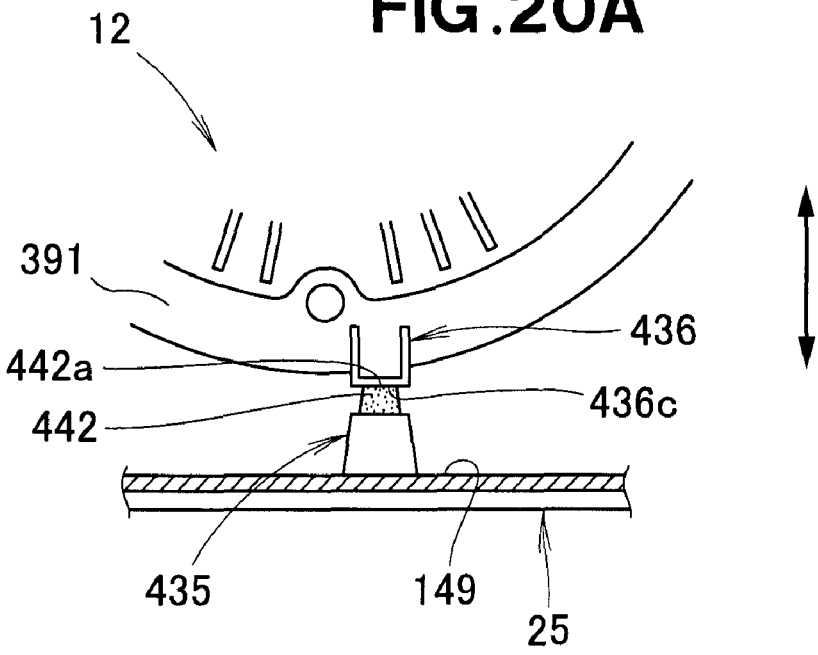
FIGS. 20A and 20B are views showing an example in which the vibrations of the engine/generator unit are minimized with the aid of the bottom vibration suppressing section.

In FIG. 20A, the bottom center bump seat section 436 vibrates together with the fan cover 391 about the center of gravity G due to the vibrations of the engine/generator unit 12 about the center of gravity G (see FIGS. 2 and 3). The bottom center bump seat section 436 vibrates together with the fan cover 391 in the direction of the arrow (the vertical direction) due to the vertical component of the vibrations. Accordingly, the bottom section 436*c* of the bottom center bump seat section 436 makes contact with the upper end 442*a* of the bottom center bump stopper 435 due to the vertical component (the component in the arrow direction) of the vibrations. The vertical component of the vibrations is thereby minimized and the vibrations of the engine/generator unit 12 are minimized.

Figure 20B:
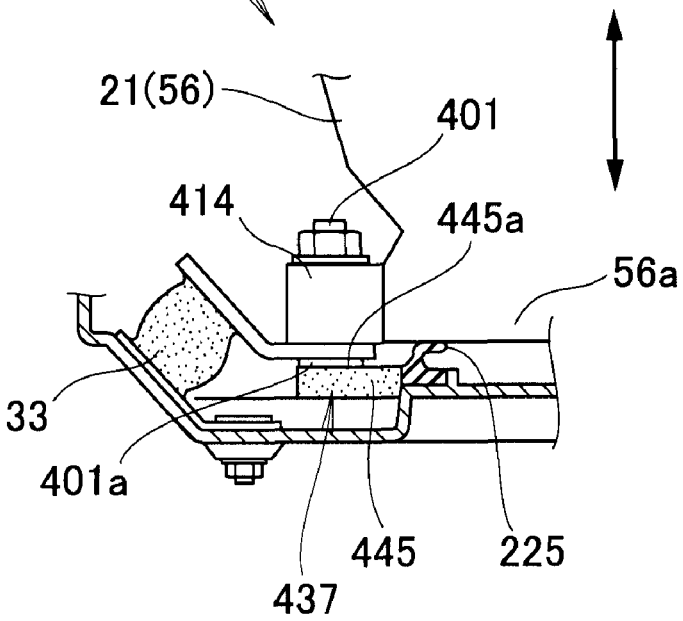

In FIG. 20B, the bottom section 56*a* of the crankcase 56 vibrates about the center of gravity G due to the vibrations of the engine/generator unit 12 about the center of gravity G (see FIGS. 2 and 3). The head section 401*a* of the bolt 401 vibrates together with the front mounting section 414 of the bottom section 56*a* in the direction of the arrow (the vertical direction) due to the vertical component of the vibrations. Accordingly, the head section 401*a* of the bolt 401 makes contact with the upper end 445*a* of the bottom front bump stopper 437 due to the vertical component of the vibrations (the component in the arrow direction). The vertical component of the vibrations is thereby minimized and the vibrations of the engine/generator unit 12 are minimized.

The bottom rear bump stopper 438 shown in FIG. 18 is symmetrical in the forward/rearward direction with the bottom front bump stopper 437, and can suppress vibrations in the same manner as the bottom front bump stopper 437.

The elastic seal member 215 is in contact with the bottom cover 25, the vertical frame 26, and an internal periphery 30 of the center frame 27 in a state which the lip 215*b* has elastically deformed, as shown in FIG. 2. Accordingly, the vibrations in the vertical direction of the engine/generator unit 12 can be minimized by the upper and lower sections of the elastic seal member 215.

The vibrations in the forward/rearward directions of the engine/generator unit 12 can be minimized by the front and rear sections of the elastic seal member 215. In other words, the elastic seal member 215 doubles as a vibration-proofing material.

The example described above is one in which the left and right wheels 31, 32 are provided to the rear-end part 25*b* of the bottom cover 25 and the leg sections 29 are provided to the front-end section 25*a* of the bottom cover 25, but no limitation is imposed thereby, and it is also possible to provide, e.g., wheels in place of the leg sections 29 of the front-end section 25*a*.

The example described above is one in which the elastic seal member 215 is formed using ethylene propylene rubber (EPDM), but ethylene propylene rubber is not provided by way of limitation to the material of the elastic seal member 215.

The skeletal member 11, the case 17, the insulating member 18, the muffler 23, the bottom cover 25, the vertical frame 26, the center frame 27, the mounting members 33, the frame beam section 195, the frame leg section 196, the elastic seal member 215, the upper center bump stopper 424, the upper center bump seat section 425, the muffler bump stopper 426, the bottom center bump stopper 435, the bottom center bump seat section 436, the bottom front bump stopper 437, the bottom rear bump stopper 438, and the like shown in the example are not limited to the depicted shapes, and may be suitably modified.

Obviously, various minor changes and modifications of the present invention are possible in light of the above teaching. It is therefore to be understood that within the scope of the appended claims the invention may be practiced otherwise than as specifically described.

What is claimed is:

1. An engine generator comprising:

an engine/generator unit in which an engine and a generator driven by the engine are provided as an integrated unit;

an electrical component section for controlling an output of the engine/generator unit;

a case for accommodating the electrical component section and the engine/generator unit;

a bottom cover for supporting the engine/generator unit;

a wall-shaped vertical frame provided transversely of the engine generator and rising from a vicinity of one end of the bottom cover; and a center frame extending from an upper center section of the vertical frame above the engine/generator unit and then downwards to contact a center section of an opposite end of the bottom cover, wherein a skeletal member comprises the bottom cover, the vertical frame and the center frame, and the vertical frame and the center frame are formed only in a T-shape as viewed in top plan.

2. The engine generator of claim 1, wherein the vertical frame partitions an accommodation space inside the case into a unit accommodation area in which the engine/generator unit is disposed, and an electrical-component-section-accommodating area in which the electrical component section is disposed.

3. The engine generator of claim 1, wherein the engine has a drive shaft extending perpendicularly to the center frame, the engine is disposed on one side of the center frame and the generator is disposed on an opposite side of the center frame, and the center frame includes a heat insulating member which partitions the unit accommodation area into a hot area for disposing the engine and a cool area for disposing the generator.

4. The engine generator of claim 1, wherein the center frame comprises:

a frame beam section extending horizontally along the bottom cover from the upper center section of the vertical frame to the opposite end center section of the bottom cover; and a frame leg section extending downwardly from a distal end of the frame beam section to the opposite end center section of the bottom cover, the frame beam section and the frame leg section being formed into an L-shape.

5. An engine generator comprising:

an engine/generator unit in which an engine and a generator driven by the engine are provided as an integrated unit an electrical component section for controlling an output of the engine/generator unit;

a case for accommodating the electrical component section and the engine/generator unit;

a bottom cover for supporting the engine/generator unit;

a wall-shaped vertical frame provided transversely of the engine generator and rising from a vicinity of one end of the bottom cover;

a center frame extending between an upper center section of the vertical frame and a center section of an opposite end of the bottom cover and disposed above the engine/generator unit;

an elastic seal member, being provided between the center frame and the engine/generator unit, for defining an area for accommodating the engine and an area for accommodating the generator;

a center bump stopper, formed integrally with the elastic seal member, for minimizing vibrations of the engine/generator unit; and a bump seat section, disposed on the center frame, for contacting with the center bump stopper, so that a horizontal component of the vibrations of the engine/generator unit is minimized as a result of the center bump stopper making contact with the bump seat section,.

wherein a skeletal member comprises the bottom cover, the vertical frame and the center frame, and the vertical frame and the center frame are formed in a T-shape as viewed in top plan.

6. The engine generator of claim 5, wherein the center frame includes a muffler bump stopper capable of making contact with a muffler disposed above the engine, and the horizontal component of the vibrations of the engine/generator unit is minimized as a result of the muffler bump stopper making contact with the muffler.

7. The engine generator of claim 5, wherein the bottom cover includes a bottom bump stopper that makes contact with a bottom section of the engine/generator unit, and a vertical component of the vibrations of the engine/generator unit is minimized as a result of the bottom bump stopper making contact with the bottom section of the engine/generator unit.

8. The engine generator of claim 1, further comprising:

an elastic seal member, being provided between the center frame and the engine/generator unit, for defining an area for accommodating the engine and an area for accommodating the generator;

a center bump stopper , formed integrally with the elastic seal member, for minimizing vibrations of the engine/generator unit; and a bump seat section, disposed on the center frame, for contacting with the center bump stopper, so that a horizontal component of the vibrations of the engine/generator unit is minimized as a result of the center bump stopper making contact with the bump seat section.

9. The engine generator of claim 8, wherein the center frame includes a muffler bump stopper capable of making contact with a muffler disposed above the engine, and the horizontal component of the vibrations of the engine/generator unit is minimized as a result of the muffler bump stopper making contact with the muffler.

10. The engine generator of claim 8, wherein the bottom cover includes a bottom bump stopper that makes contact with a bottom section of the engine/generator unit, and a vertical component of the vibrations of the engine/generator unit is minimized as a result of the bottom bump stopper making contact with the bottom section of the engine/generator unit.

* * * * *